US008939537B2

(12) United States Patent
Yasutani

(10) Patent No.: US 8,939,537 B2
(45) Date of Patent: Jan. 27, 2015

(54) INKJET PRINTING APPARATUS AND INKJET PRINTING METHOD

(71) Applicant: Canon Kabushiki Kaisha, Tokyo (JP)

(72) Inventor: Jun Yasutani, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/796,062

(22) Filed: Mar. 12, 2013

(65) Prior Publication Data

US 2013/0257944 A1 Oct. 3, 2013

(30) Foreign Application Priority Data

Apr. 3, 2012 (JP) ..... 2012-084827

(51) Int. Cl.

*B41J 29/38* (2006.01)
*B41J 2/045* (2006.01)
*B41J 2/14* (2006.01)

(52) U.S. Cl.

CPC ..... *B41J 2/0458* (2013.01); *B41J 2/0454* (2013.01); *B41J 2/04543* (2013.01); *B41J 2/04563* (2013.01); *B41J 2/04568* (2013.01); *B41J 2/04573* (2013.01); *B41J 2/04588* (2013.01); *B41J 2/0459* (2013.01); *B41J 2/04591* (2013.01); *B41J 2/04598* (2013.01); *B41J 2/14072* (2013.01)

USPC ..... 347/14; 347/19

(58) Field of Classification Search

CPC ..... B41J 2/04568; B41J 2/04563
See application file for complete search history.

(56) References Cited

U.S. PATENT DOCUMENTS

| | | | | |
|---|---|---|---|---|
| 6,243,111 | B1 * | 6/2001 | Imanaka et al. | 347/13 |
| 2001/0007457 | A1 * | 7/2001 | Nagoshi et al. | 347/19 |
| 2002/0030709 | A1 * | 3/2002 | Iwasaki et al. | 347/19 |
| 2002/0041300 | A1 * | 4/2002 | Iwasaki et al. | 347/19 |
| 2002/0113832 | A1 * | 8/2002 | Kanematsu et al. | 347/14 |
| 2003/0112292 | A1 * | 6/2003 | Lee | 347/41 |
| 2011/0221819 | A1 * | 9/2011 | Omo | 347/17 |
| 2011/0261104 | A1 * | 10/2011 | Tatsumi | 347/17 |
| 2013/0176357 | A1 * | 7/2013 | Yasutani et al. | 347/17 |

FOREIGN PATENT DOCUMENTS

| | | | |
|---|---|---|---|
| JP | 6-297718 | A | 10/1994 |
| JP | 2002-264305 | A | 9/2002 |
| JP | 2003143079 | A * | 5/2003 |

OTHER PUBLICATIONS

Seven W. Smith, "The Scientist and Engineer's Guide to Digital Signal Processing," California Technical Publishing, Second Edition 1999, Chapter 15 entitled "Moving Average Filters", pp. 277-284; acquired via http://www.analog.com/static/imported-files/tech_docs/dsp_book_Ch15.pdf on Apr. 30, 2014.*

* cited by examiner

*Primary Examiner* — Shelby Fidler
(74) *Attorney, Agent, or Firm* — Fitzpatrick, Cella, Harper & Scinto

(57) ABSTRACT

By performing an average process of a result of a plurality of times of samplings by the temperature sensor provided on a printing element substrate, temperature of the printing element substrate is obtained. In this case, the number of times of samplings is determined on the basis of a simultaneously driven number in the printing element substrate. This enables the number of times of samplings for the temperature sensor to be determined depending on a simultaneously driven number at each time, and therefore while suppressing an influence of noise, the temperature of the printing element substrate can be measured in a highly reliable state where there is no separation from an actual temperature.

14 Claims, 21 Drawing Sheets

INKJET PRINTING APPARATUS AND INKJET PRINTING METHOD

BACKGROUND OF THE INVENTION

1. Field of the Invention

The present invention relates to an inkjet printing apparatus. In particular, the present invention relates to an inkjet printing apparatus that, with use of an inkjet print head provided with a printing element substrate on which electrothermal transducing elements are arrayed, prints an image while detecting a temperature of the printing element substrate.

2. Description of the Related Art

An inkjet print head provided with electrothermal transducing elements can eject small droplets of ink at a high frequency, and a printing apparatus using such a print head can output an image at high speed and high resolution. In the inkjet print head provided with electrothermal transducing elements, a voltage pulse is applied to the electrothermal transducing elements according to an ink ejection signal. The inkjet print head is configured such that, by doing so, film boiling occurs in ink in contact with the electrothermal transducing elements, and by growth energy of generated bubbles, ink droplets are ejected from ejection ports (nozzles).

In such an inkjet print head, temperature of a printing element substrate on which the plurality of electrothermal transducing elements are arrayed is changed depending on the number of times of driving, i.e., the number of times of ejection of each of the electrothermal transducing elements. Also, a size of forming bubble, i.e., an amount of ink ejected from an ejection port (ejection amount) in a corresponding electrothermal transducing element depends on the temperature of the printing element substrate. On the other hand, the ejection amount is also changed by the pulse shape of the voltage pulse applied to the electrothermal transducing element. From the above, in many of inkjet printing apparatuses each of which is mounted with an inkjet print head provided with electrothermal transducing elements, a pulse shape to be applied to the electrothermal transducing elements is adjusted depending on a detected temperature of a printing element substrate to keep a stable ejection amount independently of the temperature of the printing element substrate.

Meanwhile, in an inkjet printing apparatus of recent years, along with an increase in length of a print head, an increase in the number of nozzle arrays, and further an increase in size of a printing medium toward A3 or A2 sizes, a temperature rise during one scan of the print head has become marked. For this reason, it has been required to, during the scan of the print head, perform feedback control that detects a temperature of the print head, and on the basis of the detected temperature, modulates a voltage pulse to be applied to electrothermal transducing elements. In this case, an output signal of a temperature sensor is an analog signal, and a wing line for the signal is arranged on a printing element substrate with being in close contact with other wing line for driving signals for the electrothermal transducing elements and logic signals for controlling ink ejection nozzles and ejection timing. Also, the analog signal is transmitted to a main board of a main body through a flexible cable that is bent along with the scan of the print head. From the above, on the output signal of the temperature sensor, which is transmitted during the print scan, noise due to interference with the other signals is inevitably superimposed.

For example, Japanese Patent Laid-Open No. H06-297718 (1994) discloses a method that, from a print duty (print density) per unit time, estimates a temperature rise of a print head, and adds the estimated temperature rise to a detected temperature before ejection to determine a pulse shape of a driving signal. Also, Japanese Patent Laid-Open No. 2002-264305 discloses a method that, in accordance with timing when driving signals to all electrothermal transducing elements on a printing element substrate are in a disable (OFF) state, monitors a temperature sensor on the printing element substrate. According to the method in Japanese Patent Laid-Open No. H06-297718 (1994) or Japanese Patent Laid-Open No. 2002-264305, during ejection of the print head, i.e., during transmission of the driving signal, a temperature detection signal is not detected or transmitted, and therefore noise due to interference with the other signals is not provided to a temperature sensor output signal, and therefore a highly reliable head temperature can be obtained.

Meanwhile, in the method of Japanese Patent Laid-Open No. H06-297718 (1994), in order to estimate the temperature rise of the print head, it is necessary to temporarily store the print duty per unit time. In this case, in a recent print head configuration that is long-sized and provided with a number of nozzle arrays, a large-capacity memory is required, and a capacity of a main body memory of a printing apparatus may be made tight.

Also, as in Japanese Patent Laid-Open No. 2002-264305, even in the case of attempting to use the timing when the driving signals are in the disable (OFF) state, in a situation where an ejection operation is performed by the plurality of nozzle arrays at a high frequency, ensuring itself of the timing of the disable state is difficult. In particular, in a situation where further increases in speed and resolution are required, an ejection frequency of the print head is increased to cause a drastic temperature rise, and therefore the monitoring of the temperature sensor is more frequently required. However, on the other hand, the timing of the disable state is also increasingly reduced in duration, and therefore performance itself of the method in Japanese Patent Laid-Open No. 2002-264305 becomes difficult.

On the other hand, even in the configuration adapted to detect and transmit the temperature detection signal during transmission of the driving signal, a method that increases the number of times of samplings per unit time to suppress noise by a moving average process is possible. However, in this case, obtained head temperature has a problem of being unable to follow a temperature change along with a drastic change in the number of times of simultaneous driving.

SUMMARY OF THE INVENTION

The present invention is made in order to solve the above-described problems. Therefore, an object of the present invention is to provide an inkjet printing apparatus and temperature obtaining method that, even in a configuration of a long-sized print head provided with a number of nozzle arrays, enable a head temperature during an ejection operation to be obtained in a highly reliable state.

In a first aspect of the present invention, there is provided an inkjet printing apparatus comprising: a printing element substrate provided with a printing element array adapted to array a plurality of printing elements ejecting ink by applying a driving pulse, and a temperature sensor; a temperature obtaining unit configured to perform an average process of a plurality of output values outputted from the temperature sensor, and thereby obtain a temperature of the printing element substrate; and an adjustment unit configured to, on a basis of the temperature obtained by the temperature obtaining unit, adjust a shape of the driving pulse to be applied to the printing elements, wherein the temperature obtaining unit determines a number of output values used for the average process on a basis of a number of simultaneously driven printing elements on the printing element substrate.

In a second aspect of the present invention, there is provided an inkjet printing method of an ink jet printing apparatus which comprises a printing element substrate provided with a printing element array adapted to array a plurality of printing elements ejecting ink by applying a driving pulse, and a temperature sensor, the inkjet printing method comprising: a temperature obtaining step of performing an average process of a plurality of output values outputted from the temperature sensor, and thereby obtaining a temperature of the printing element substrate; and an adjustment step of, on a basis of the temperature of the printing element substrate, the temperature being obtained in the temperature obtaining step, adjusting a shape of the driving pulse to be applied to the printing elements, wherein a number of output values used for the average process in the temperature obtaining step is determined on a basis of a number of simultaneously driven printing elements on the printing element substrate.

Further features of the present invention will become apparent from the following description of exemplary embodiments with reference to the attached drawings.

DESCRIPTION OF THE EMBODIMENTS

First Embodiment

In the following, an embodiment of the present invention is described in detail with reference to the drawings.

Figure 1:
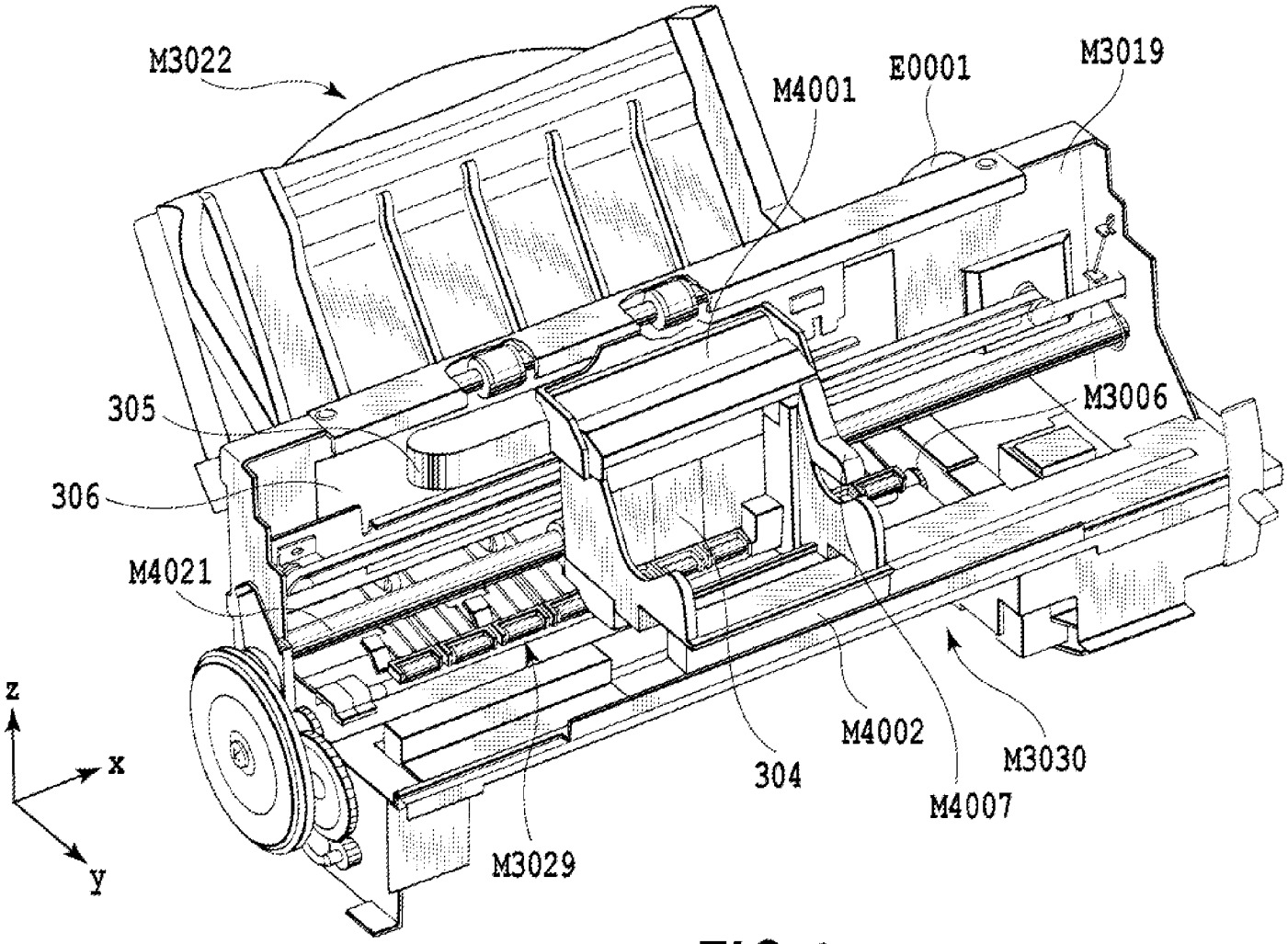
FIG. 1 is a perspective view illustrating an internal configuration of an inkjet printing apparatus usable in the present invention.

FIG. 1 is a perspective view illustrating an internal configuration of an inkjet printing apparatus used in the present embodiment. A print head H (not illustrated) attachable/detachable to/from a carriage M4001 is attached inside the carriage M4001 by a head set lever M4007 with engaging with a carriage cover M4002. The carriage M4001 can reciprocate in an X direction in the view with use of a carriage motor E0001 as a drive source with being guided and supported by a carriage shaft M4021. During the reciprocation, the print head H ejects ink droplets in a −Z direction toward a currently conveyed print medium according to a driving signal. Print data, and a temperature sensor output signal from a printing element substrate, which are required for the print head H to perform the ejection, are transceived through a cable 305 and a carriage board 304 fixed to the carriage M4001. The cable 305 makes an electrical connection between the carriage M4001 and a main board 306 fixed to a chassis M3019 with following the reciprocation of the carriage M4001.

A print medium (not illustrated) placed on a paper feed tray M3022 is fed into the apparatus, and then with being placed between a roller pair of a conveying roller M3006 and a pinch roller M3029, conveyed in a Y direction in the view along with rotation of the roller pair. A print scan in the X direction by the print head H mounted inside the carriage M4001, and a conveying operation of the print medium, which corresponds to a print width of the print head H, are alternately repeated, and thereby the print medium is printed with an image in a stepwise manner, and then discharged from a discharge port M3030.

Figure 2:
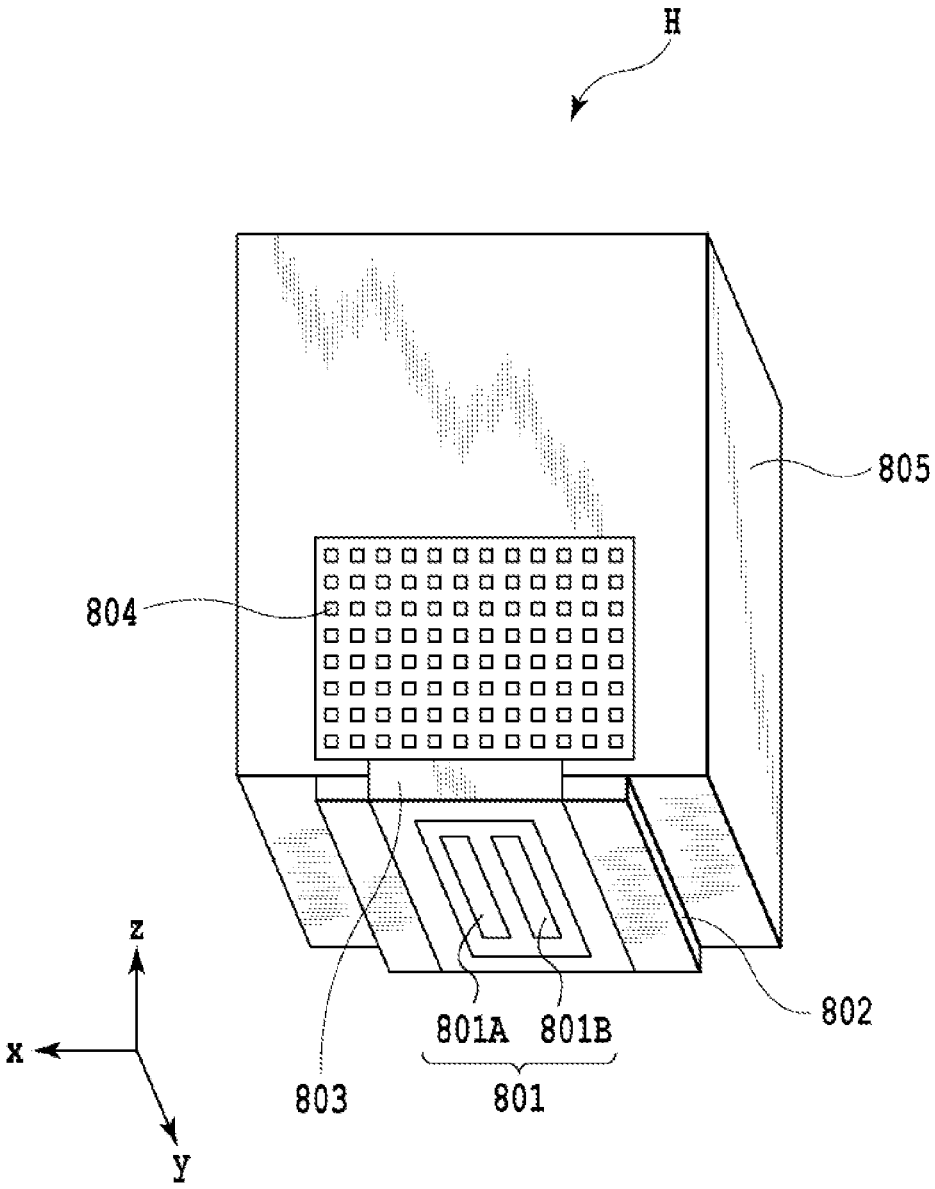
FIG. 2 is an outside perspective view of a print head H.

FIG. 2 is an outside perspective view of the print head H. Two printing element substrates 801 (801A and 801B) each formed with a plurality of printing elements are formed on a support board 802, and eject ink, which is supplied from an unillustrated ink supply unit, as droplets in the −Z direction along with application of a driving pulse. In each of the printing element substrates 801, the driving pulse is applied to a plurality of electrothermal transducing elements (heaters) that are prepared with being related to the respective printing elements. The driving signal for generating the driving pulse is inputted to the printing element substrate 801 through a contact terminal wiring board 804, a sheet electric wiring board 803, and the like. The contact terminal wiring board 804 is configured to be electrically connected to the carriage board 304 when the print head His attached inside the carriage M4001.

Each of the printing element substrates 801 is configured such that on one surface of a Si substrate, the plurality of electrothermal transducing elements and wiring lines made of Al or the like for supplying power to the respective electrothermal transducing elements are formed by a deposition technique. Also, a plurality of ejection ports respectively related to the electrothermal transducing elements and ink paths for respectively guiding the ink to the ejection ports are formed by a photolithography technique. A set of electrothermal transducing element, ejection port, and ink path that are related to one another demarcates one printing element.

The support board 802 is made of a material such as aluminum, aluminum alloy, or ceramics, and supports the printing element substrates 801 as well as carrying a role as a heat radiating member for efficiently radiating generated heat associated with heating. The support board 802 is formed with: an ink supply port for receiving the ink from the ink supply unit; and a common liquid chamber for guiding the ink to the plurality of ink paths in common. The common liquid chamber is formed so as to open from a surface joined to the printing element substrates 801, and the ink supply port is formed so as to open from a surface of the support board on a side opposite to the joining surface. The printing element substrates 801 are joined to the joining surface of the support board 802, and thereby ink liquid chambers of the printing element substrates 801 and the common liquid chamber of the support board 802 are communicatively connected to each other.

As the sheet electric wiring board 803, a flexible wiring board or the like is used, and joined and retained so as to be electrically connected to the printing element substrates 801. The sheet electric wiring board 803 and the contact terminal wiring board 804 are connected to each other by means of lead bonding, wire bonding, patterning, connector, or the like.

In the present embodiment, it is assumed that on each of the printing element substrates 801A and 801B, four nozzle arrays each adapted such that 768 nozzles are arrayed in the Y direction are parallel arranged in the X direction.

Figure 3:
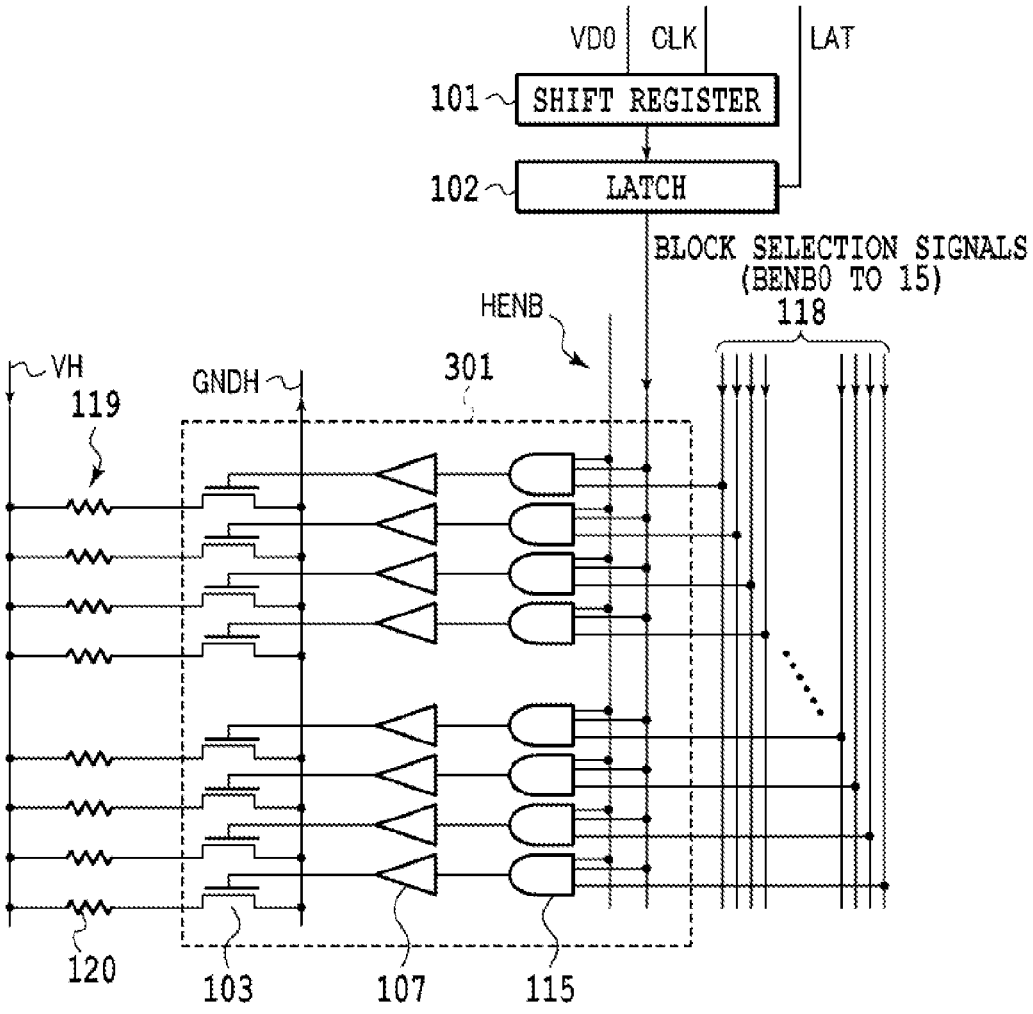
FIG. 3 is a diagram illustrating part of a drive control circuit for one printing element array on a printing element substrate.

FIG. 3 is a diagram illustrating a drive control circuit corresponding to one group in one of the printing element arrays on each of the printing element substrates 801. On the printing element substrate 801, the 768 electrothermal transducing elements 120 are arrayed in a direction intersecting with the direction in which the carriage is scanned, and constitute the printing element array 119. The 768 electrothermal transducing elements 120 are divided in units of a plurality of continuous electrothermal transducing elements to configure a plurality of groups. For the electrothermal transducing elements 120, the drive control circuit 301 for controlling driving is provided, and the drive control circuit 301 is provided with AND circuits 115, voltage conversion circuits 107, and switching elements 103. The AND circuits 115 are circuits for selecting arbitrary electrothermal transducing elements, and each of the voltage conversion circuits 107 converts a voltage level of an output signal of a corresponding AND circuit 115 to a voltage level for driving a corresponding switching element 103. Note that N electrothermal transducing elements 120, N switching elements 103, and N AND circuit2 115 form one of the groups. M (the plurality of) groups are provided to constitute the printing element array. In addition, according to block selection signals 118, the N electrothermal transducing elements 120 perform so-called time division driving by which one of the N electrothermal transducing elements is selected and driven in a time division manner.

Binary image data (VDO) is, in synchronization with a transfer clock (CLK), inputted to a shift register 101 provided so as to correspond to each of the groups; subjected to serial-parallel conversion; and latched by a latch circuit 102 according to a latch signal (LAT).

A heater driving signal (HENB) is equally inputted to all of the AND circuits 115; however, the block selection signals (BENB0 to 15) are respectively inputted to the AND circuits 115 at different timing for each of the blocks. The print data outputted from the latch circuit 102, the heater driving signal (HENB), and the block selection signals (BENB0 to 15) are subjected to an AND operation by the AND circuits 115 to output the driving signals, on the basis of which the respective printing elements are driven.

Each of the printing element substrates 801 of the present embodiment is inputted with the 16 types of block selection signals (BENB0 to 15) and can thereby perform 16-time-division driving, and a drive element array includes 48 groups. That is, the present embodiment is configured to be able to simultaneously drive 48 electrothermal transducing elements respectively belonging to the same blocks of the 48 groups in each of the printing element arrays. In other words, the inkjet printing apparatus and print head of the present embodiment are configured to be able to simultaneously drive, among the 3072 electrothermal transducing elements of all of the four printing element arrays on each of the printing element substrates, 192 electrothermal transducing elements.

In the present embodiment, on each of the printing element substrates, the drive circuit as described above is prepared for each of the (four) nozzle arrays. A pulse shape of each of the heater driving signals (HENB) is changed depending on a detected temperature of each of the printing element substrates 804.

Figure 4:
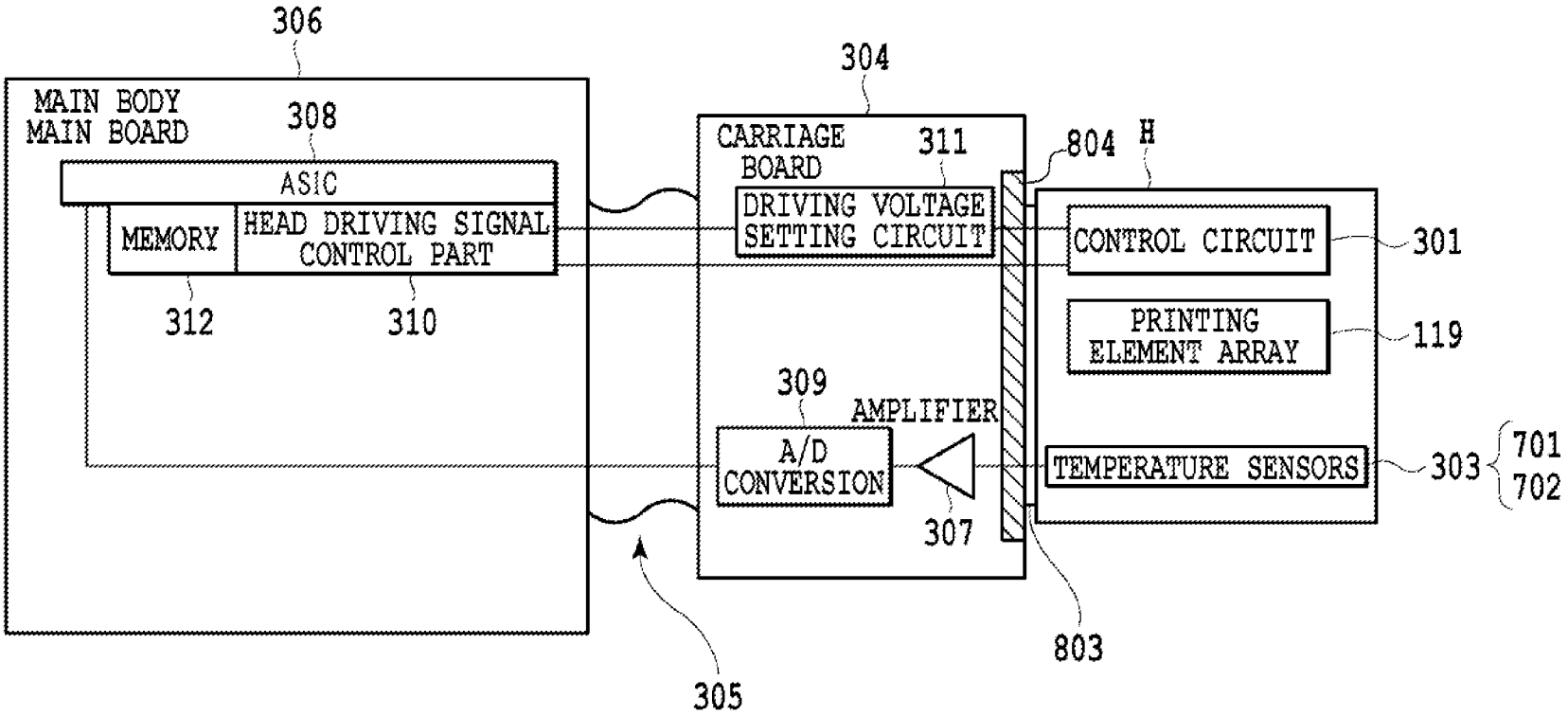
FIG. 4 is a diagram illustrating transmission of a driving signal from a main board to the printing element substrate, and a circuit configuration.

FIG. 4 is a diagram illustrating a transmission path of the driving signal from the main board 306 to each of the printing element substrates 801, and a circuit configuration. A parameter signal generated in the main board 306 of the printing apparatus main body is inputted to the carriage board 304 through the cable 305 together with the print data temporarily stored in the memory 312. Then, the parameter signal is transmitted to the printing element substrate 801 through the contact terminal wiring board 804, sheet electric wiring board 803.

On each of the printing element substrates 801, in addition to the control circuits 301 each illustrated in FIG. 3, a plurality of temperature sensors 303 for measuring a temperature of the printing element substrate 801 is equipped. Analog signals detected by the temperature sensors 303 are inputted to the carriage board 304 through the sheet electric wiring board 803 and contact wiring board 804. On the carriage board 304, the analog signals are subjected to an amplification process by an amplifier 307, and then converted into pieces of digital data, which are subsequently transmitted to the main board 306 through the cable 305.

On the basis of the plurality of digital-converted temperature data, an ASIC 308 that controls the whole of the printing apparatus estimates the temperature of the printing element substrate 801, and instructs a head driving signal control part 310 to adjust the driving pulse to have an appropriate shape. The head driving signal control part 310 sets a pulse parameter corresponding to the pieces of obtained temperature data, and transmits the parameter to the carriage board 304 through the cable 305. A driving voltage setting circuit 311 that is arranged on the carriage board 304 and includes a D/A converter generates each of the heater driving signals (HENB) according to the parameter received from the head driving signal control part 310, and transmits the heater driving signal (HENB) toward a corresponding one of the control circuits 301. In this case, the heater driving signal (HENB) may be adjusted by providing a DC/DC converter in the control circuit 301.

In addition, in the past, the amplifier 307 and the A/D converter 309 have been often provided on the main board 306, and in this case, data has been transmitted along a long wiring path from the control circuit 301 to the main board 306 in an analog signal state, and therefore often influenced by noise. As in the present embodiment, by providing the amplifier 307 and the A/D converter 309 on the carriage board 304, wiring lengths required to transmit the pieces of data from the temperature sensors 303 in the analog signal state can be shortened, and therefore an influence of noise can be reduced. Note that the present embodiment is not limited to such a configuration. The present embodiment may be configured to equip the main board 306 with both of the amplifier 307 and the A/D converter 309, or only the A/D converter 309.

Figure 5:
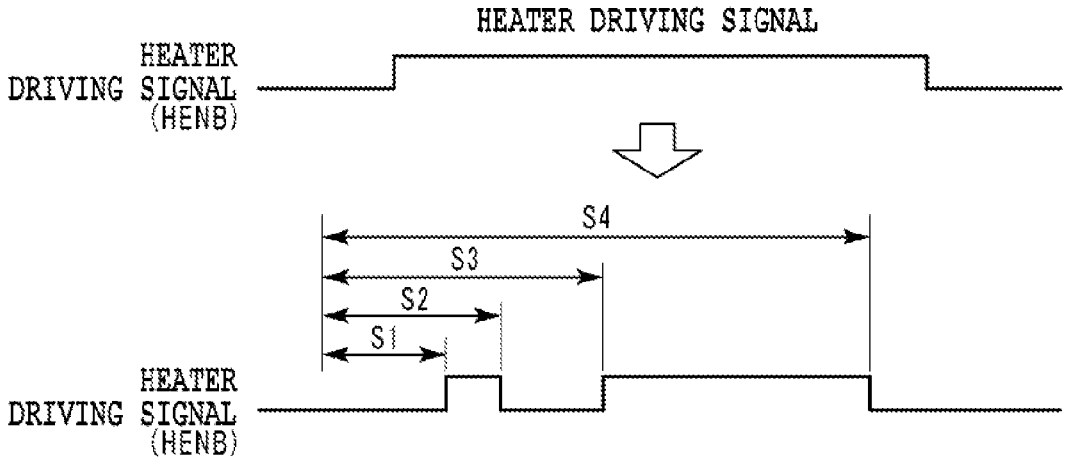
FIG. 5 is a diagram illustrating an example of a heater driving signal (HEMB) corresponding to one ejection operation.

FIG. 5 is a diagram illustrating an example of each of the heater driving signals (HENB) corresponding to one ejection operation. The horizontal axis represents time, and the vertical axis represents voltage. The upper tier illustrates an example of a single pulse, and the lower tier illustrates an example of a double pulse. In the case of the single pulse, an ejection amount can be modulated by changing a pulse width or voltage of the single pulse. For example, in the case where a detected temperature of each of the printing element substrates is high, viscosity of the ink is low, and therefore if the same energy is applied, the ejection amount tends to be larger than a standard value. Therefore, in this case, by applying a driving pulse having a higher drive voltage and a shorter pulse width than standard values, respectively, a time necessary for heat to transfer from an electrothermal transducing element to the ink is kept short to decrease the ejection amount. On the other hand, in the case where the detected temperature of the printing element substrate is low, the viscosity of the ink is high, and therefore if the same energy is applied, the ejection amount tends to be smaller than the standard value. Therefore, in this case, by applying a driving pulse having a lower drive voltage and a longer pulse width than the standard values, respectively, the time necessary for the heat to transfer from the electrothermal transducing element to the ink is increased to increase the ejection amount.

On the other hand, in the case of the double pulse, the ejection amount can be modulated by changing a width of a prepulse (S2-S1) preliminarily applied before a main pulse (S4-S3) contributing to actual ejection, or a width of an interval (S3-S2). For example, in the case where the detected temperature of the printing element substrate is high, by decreasing the width of the prepulse (S2-S1) and increasing the width of the interval (S3-S2), a temperature rise of the ink in contact with the electrothermal transducing element can be suppressed to decrease the ejection amount. On the other hand, in the case where the detected temperature of the printing element substrate is low, by increasing the width of the prepulse (S2-S1) and decreasing the width of the interval (S3-S2), temperature of the ink in contact with the electrothermal transducing element can be increased to increase the ejection amount.

As described, by changing a pulse width or a voltage on the basis of the temperature of the printing element substrate, control to make the ink ejection amount constantly keep a constant amount can be performed to prevent density unevenness from occurring in a printed image.

Figure 6:
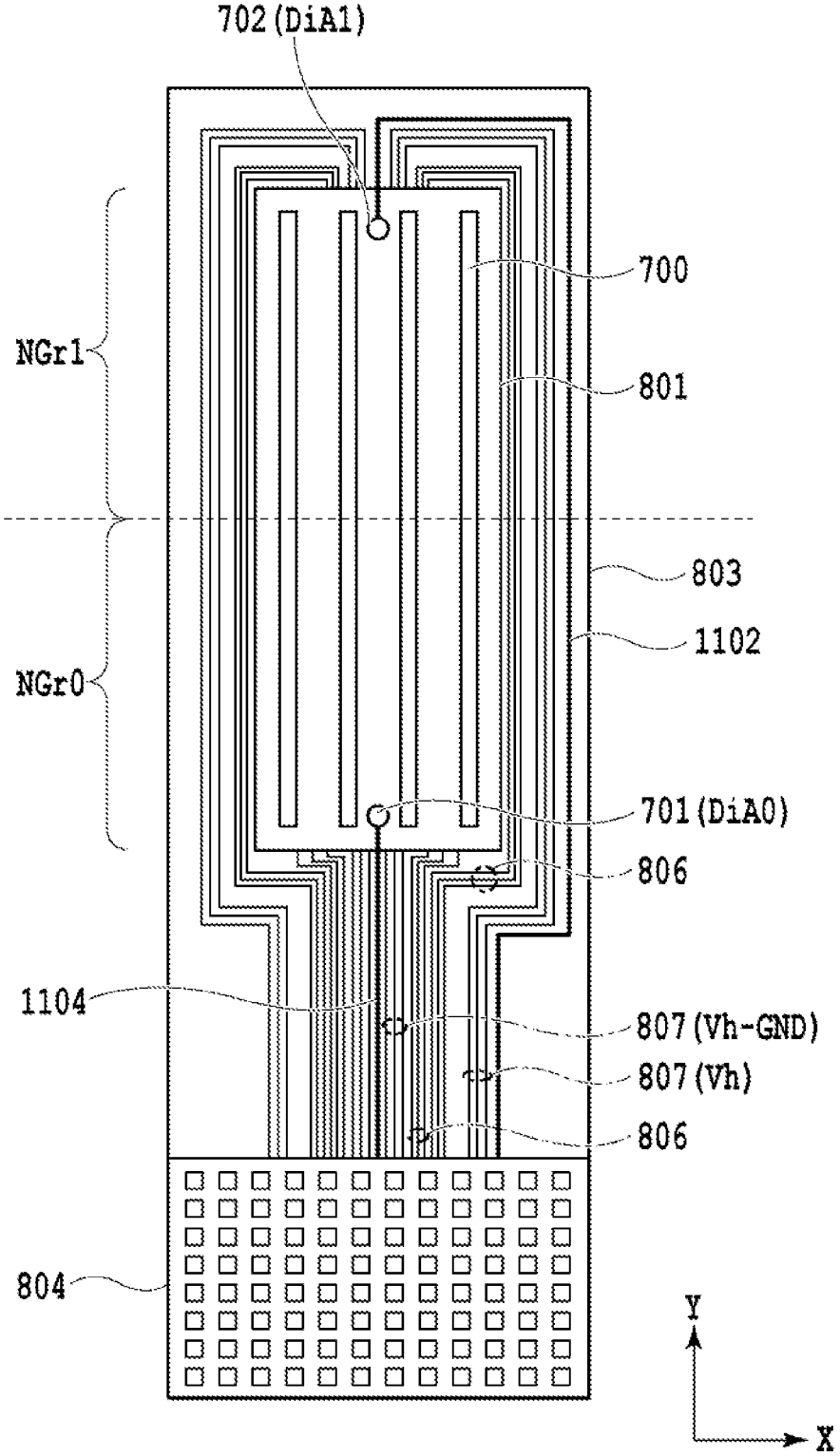
FIG. 6 is a diagram in which the printing element substrate 801 is observed from an ejection port face.

FIG. 6 is a diagram in which one of the printing element substrates 801 is observed from an ejection port face. On the printing element substrate 801 of the present embodiment, the four electrothermal transducing element arrays 700 each including the 768 electrothermal transducing elements arrayed at pitches of 1200 dpi in the Y direction are arranged in the X direction, and the 3072 electrothermal transducing elements in total are equipped. Also, the control circuit 301 illustrated in FIG. 3 is formed with corresponding to each of the electrothermal transducing element arrays.

The printing element substrate 801 of the present embodiment is equipped with the temperature sensors 701 and 702, and on the basis of output values of the temperature sensors, the temperature of the whole of the printing element substrate 801 is estimated. In the present embodiment, the temperature sensors 701 and 702 are respectively diode sensors (DiA0 and DiA1), and use a characteristic of a temperature-dependent change in forward voltage. Note that any temperature detecting device other than the diode can also be used. The sheet electric wiring board 803 is provided with: logic signal lines 806 for transmitting the block selection signals and image data to the printing element substrate; drive voltage (Vh) supply lines 807; and ground lines for drive voltage (Vh_GND) 807. Further, DiA1 and DiA0 wiring lines 1102 and 1104 (signal wiring lines) for respectively transmitting the output signals of the temperature sensors 702 and 701 to the carriage board are also provided. The above wiring lines are provided with respectively having parts parallel to one another on the sheet electric wiring board 803. For this reason, if a large current flows through any of the drive voltage supply lines 807, output signals of the logic signal lines 806, and DiA1 and DiA0 wiring lines 1102 and 1104 are influenced by electromagnetic induction noise. In particular, the DiA1 wiring line 1102 is disposed near the drive voltage supply lines 807, and therefore it can be said that the DiA1 wiring line 1102 may be largely influenced. In addition, if the electromagnetic induction noise occurs in the temperature sensor output signal, the temperature cannot be accurately measured.

The time when the large current flows through any of the drive voltage supply wiring lines 807 is a time when the number of simultaneously driven electrothermal transducing elements on the printing element substrate 801 is large. In the case where the number of simultaneously driven electrothermal transducing elements (hereinafter referred to as the "simultaneously driven number") is large, the temperature rise of the printing element substrate 801 is also large, and in order to output a high-quality image, it is necessary to detect an accurate temperature to perform appropriate driving pulse control on the electrothermal transducing elements. In particular, because of a situation of desiring to measure the accurate temperature, a measurement error due to the electromagnetic induction noise is desirably reduced.

Figure 7:
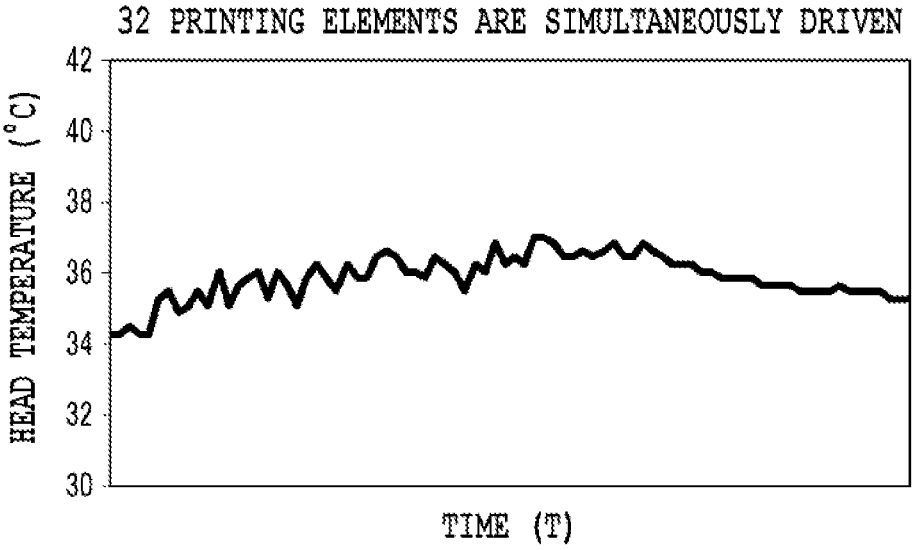
FIG. 7 is a diagram illustrating a head temperature corresponding to output values of temperature sensors in the case where 32 printing elements are simultaneously driven.
Figure 8:
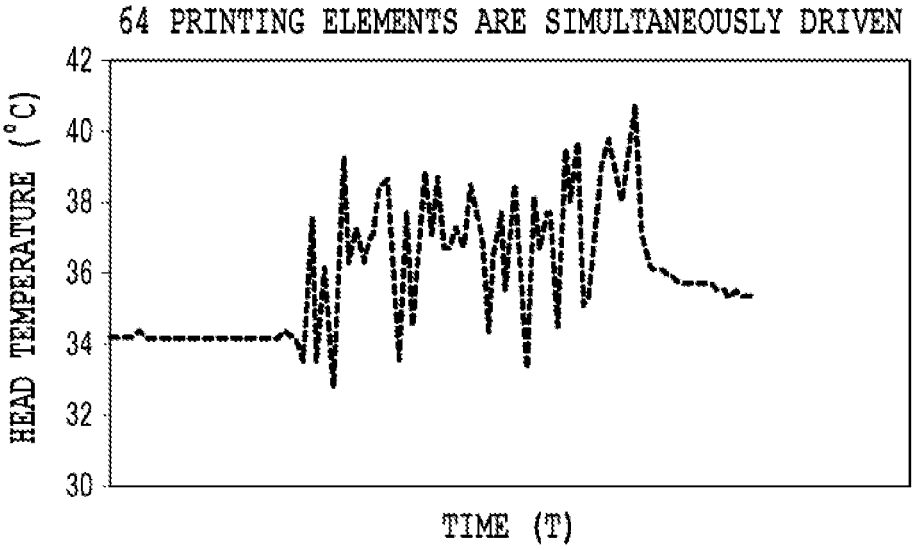
FIG. 8 is a diagram illustrating a head temperature corresponding to output values of the temperature sensors in the case where 64 printing elements are simultaneously driven.

FIG. 7 is a diagram illustrating a head temperature corresponding to output values detected by the temperature sensors in the case where in one of the printing element substrates, a state where among the 192 printing elements that can simultaneously perform ejection, 32 printing elements are simultaneously driven continues for 500 msec. Also, FIG. 8 is a diagram illustrating a head temperature corresponding to output values detected by the temperature sensors in the case where a state where among the 192 printing elements, 64 printing elements are simultaneously driven continues for 500 msec. In any of the diagrams, the horizontal axis is a time axis, and the vertical axis represents the head temperature converted from the output values of the temperature sensors. It is here assumed that the output values of the temperature sensors are obtained at a sampling rate having a regular time interval of 100 msec. When comparing the both diagrams with each other, noise is hardly superimposed on the temperature sensor output values illustrated in FIG. 7, whereas much noise is superimposed on the temperature sensor output values illustrated in FIG. 8, and reliability of a value at each time is low. That is, if on the basis of such output values, temperature information including a measurement error is used to perform the drive control of the print head, in the case of FIG. 8, inappropriate ejection amount control is performed, and the ink ejection amount cannot be appropriately controlled, so that concern about causing a harmful influence such as density unevenness in a printed image is increased. Therefore, in the present embodiment, in order to further reduce noise components from the above output values, by performing an average process on pluralities of sampled temperature sensor output values, smoothed corrected output values of the temperature sensors are obtained.

Figure 9:
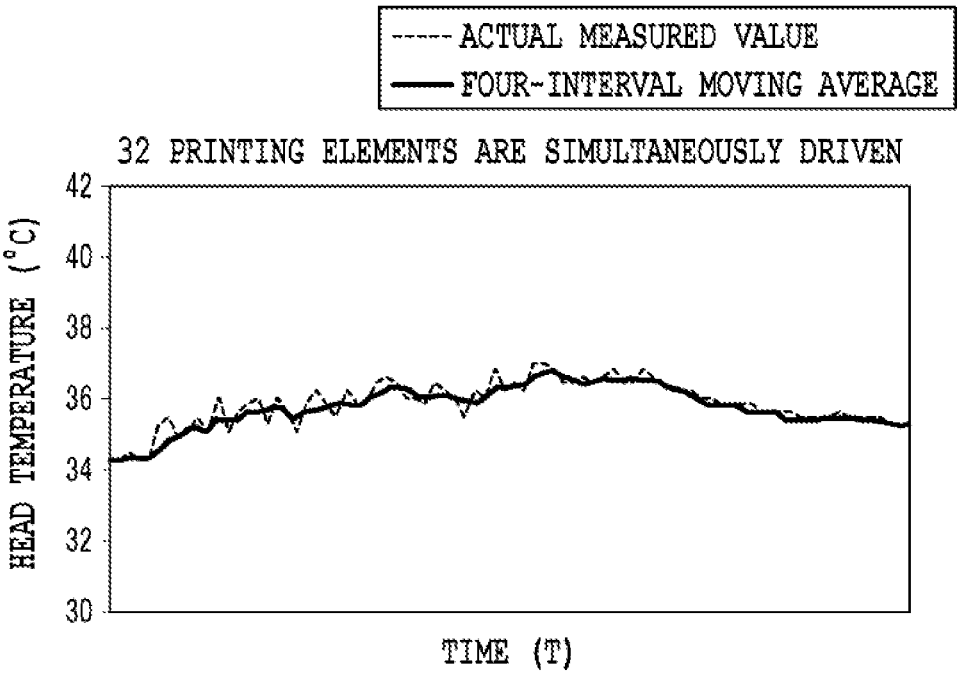
FIG. 9 is a diagram illustrating a head temperature corresponding to a corrected output value in the case where a moving average process is performed for every four intervals.

FIG. 9 is a diagram illustrating temperature sensor corrected output values (corrected temperature) in the case where a moving average process is performed on the result in FIG. 7 with use of sampled output values for every four intervals (four output values). As compared with FIG. 7, it is recognized that a noise component having a level of ±1.0° C. or more is canceled.

Figure 10:
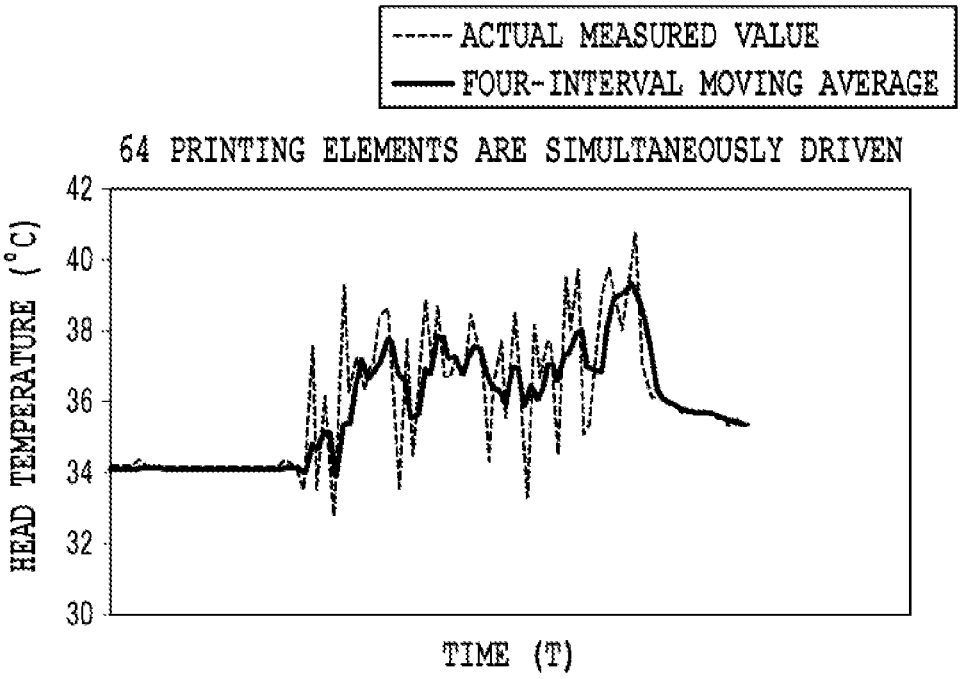
FIG. 10 is a diagram illustrating a head temperature corresponding to a corrected output value in the case where the moving average process is performed for every four intervals.

On the other hand, FIG. 10 is a diagram illustrating temperature sensor corrected output values in the case where the moving average process is performed on the result in FIG. 8 with use of sampled output values for every four intervals. As compared with FIG. 8, noise components are reduced; however, as compared with FIG. 9, it turns out that the noise component having a level of ±1.0° C. or more still remains, and the influence of noise cannot be sufficiently reduced.

Figure 11:
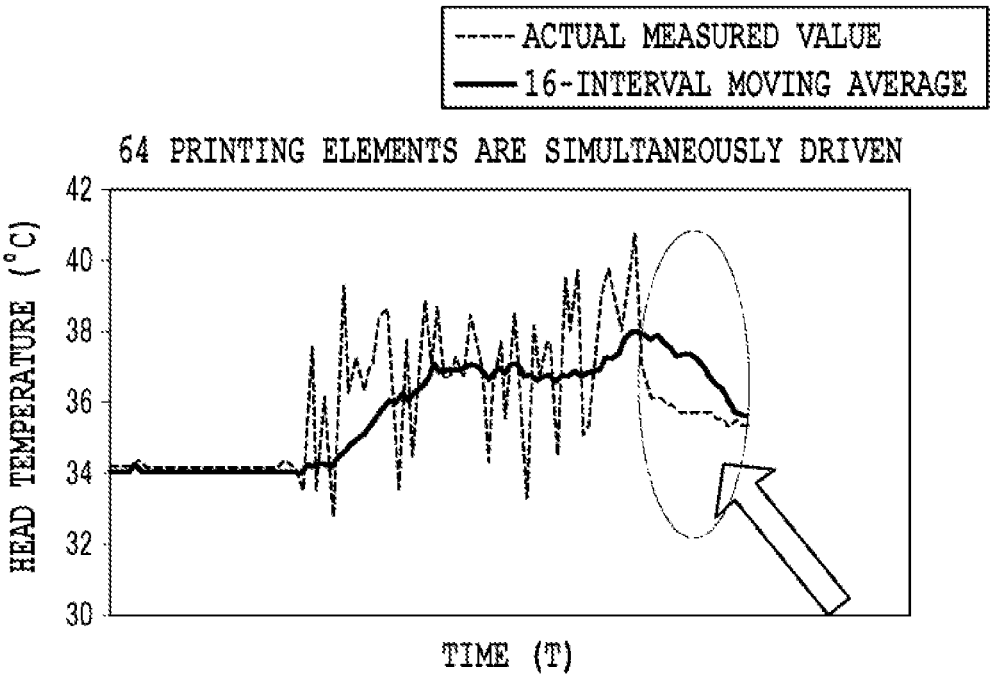
FIG. 11 is a diagram illustrating a head temperature corresponding to a corrected output value in the case where a moving average process is performed for every 16 intervals.

FIG. 11 is a diagram illustrating temperature sensor corrected output values in the case where the moving average process is performed on the result in FIG. 8 with use of sampled output values for every 16 intervals. As compared with FIG. 8, it turns out that the noise components are further reduced and kept equal to or less than a level of ±1.0° C., and can be reduced to the extent of being able to suppress the harmful influence such as density unevenness.

As described, it can be said that as the number of samples used for the moving average process is increased, the noise components can be further reduced.

However, increasing the number of samples used for the moving average process also causes a disadvantage of slowing down followability to a rapid change of an event. For example, a region surrounded by a broken line in FIG. 11 is a region where after 500 msec during which the 64 printing elements have been simultaneously driven, the driving is stopped, and between a head temperature obtained by actual measurement (actual measured value) and the corrected temperature obtained by performing the moving average process, separation occurs. This is because the moving average process is performed with use of a current output value and a plurality of output values having been sampled in the past, which makes it difficult to reflect a current drastic change. That is, simultaneously with stopping the simultaneous driving of the 64 printing elements, the temperature of the print head is decreased; however, in the moving average process, the output values having been sampled in the past during the simultaneous driving are also used to perform the average process, and therefore the head temperature after the smoothing process exceeds the measured value.

Figure 12:
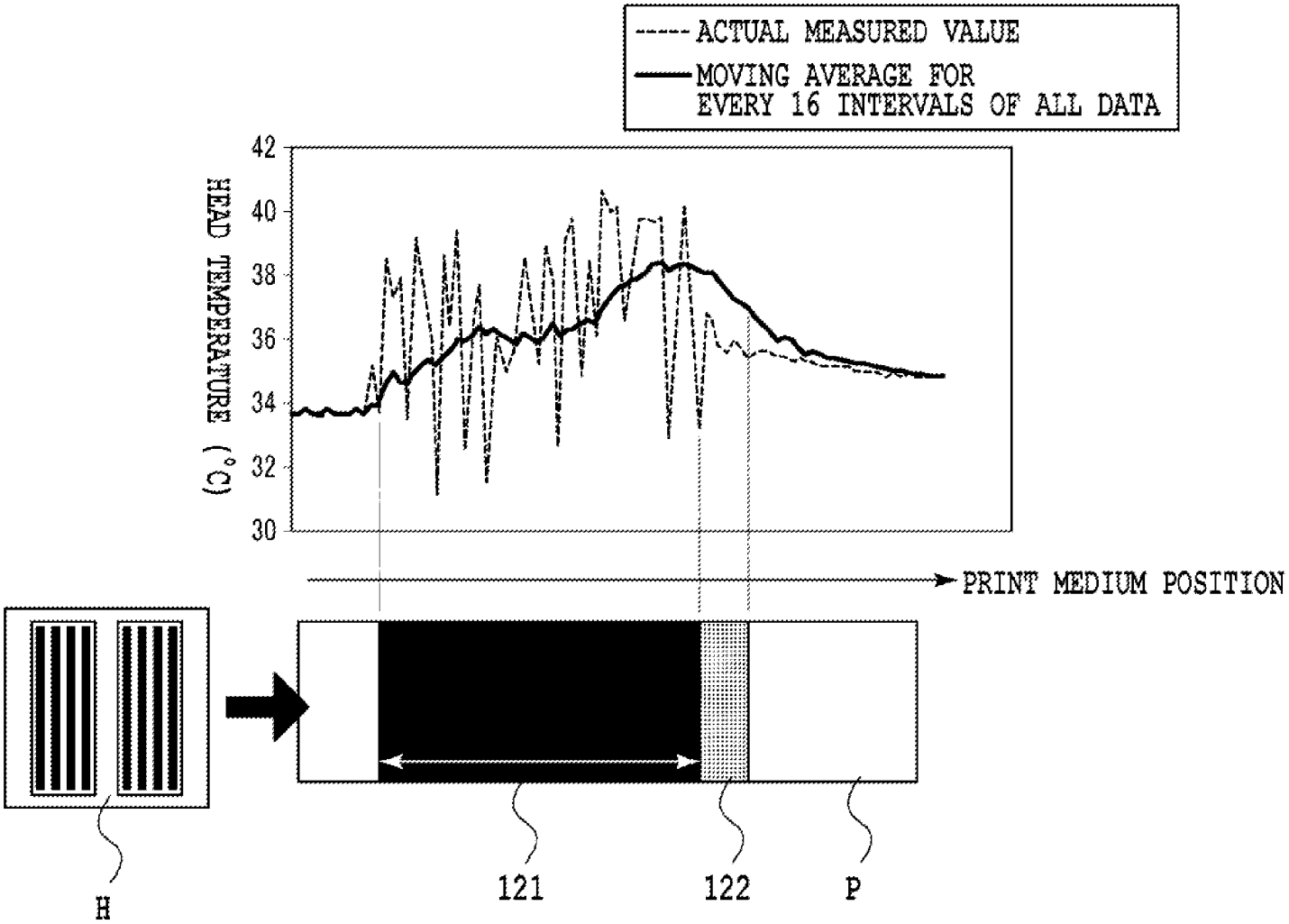
FIG. 12 is a diagram illustrating a relationship between a print duty and a head temperature of the print head.

FIG. 12 is a diagram illustrating a relationship between a print duty and a head temperature of the print head. In the diagram, the horizontal axis represents a position of the print head H with respect to a print medium, and the vertical axis represents the head temperature. Illustrated here is the case of, while moving the print head H in a direction indicated by an arrow, printing in a high duty region 121 where the simultaneously driven number is 64, then printing in a low duty region 122 where the simultaneously driven number is 16, and making the print duty zero. In the case of printing in the high duty region 121, as in FIG. 11, it can be said that a corrected temperature obtained by using a sampling result for every 16 intervals to perform the average process has more reduced noise, and is therefore more appropriate for the use for the drive control of the print head. However, in the case of printing in the low duty region 122, the corrected temperature is separated from a measured head temperature, and therefore it cannot be said that it is appropriate to use the corrected temperature for the drive control of the print head.

The present inventors, in accord with such phenomenon, have arrived at the knowledge that, in order to obtain a more accurate head temperature, it is effective to determine the number of detected temperature samples used to perform the moving average process depending on the simultaneously driven number at each time. Specifically, in the case where the simultaneously driven number is large, much noise is present, and even if the moving average process is performed, separation from a measured value is unlikely to occur, so that the average process is performed with use of a relatively large number of samples. On the other hand, in the case where the simultaneously driven number is small, original noise is less, and if the number of samples is large, separation from a measured value at the time when the moving average process is performed is concerned, so that the average process is performed with use of a relatively small number of samples.

Figure 14:
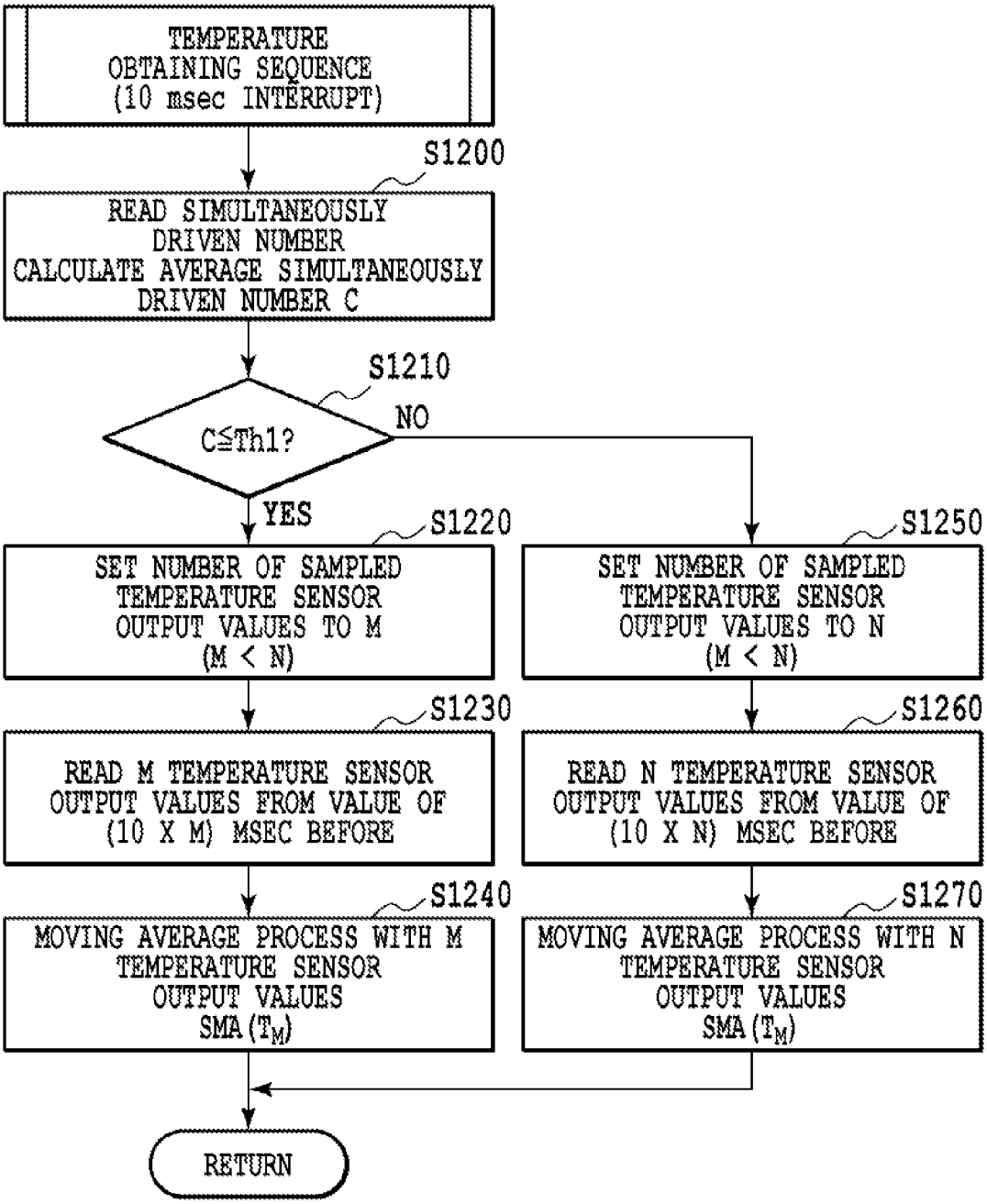
FIG. 14 is a flowchart explaining a temperature detecting sequence in the first embodiment.

FIG. 14 is a flowchart for explaining a temperature detecting sequence for each of the printing element substrates 801, which is performed by the ASIC 308 of the present embodiment. This sequence is assumed to be subjected to an interrupt process at intervals of 10 msec during a period of time from a time when the printing apparatus receives a print start job to a time when the job ends. It should be appreciated that the intervals of 10 msec can be changed depending on a situation.

When this sequence is started, in Step S1200, the ASIC 308 first searches the memory 312 of the main body main board 306, and on the basis of print data stored in the memory 312, counts the number of driving of printing elements within a predetermined period of time in the printing element substrate 801. Then, from the driven number, the ASIC 308 calculates an average simultaneously driven number C per one drive timing in the printing element substrate. In the present embodiment, the simultaneously driven number C at one drive timing as described above is temporarily stored in the memory 312, and along with storing a driven number within the next predetermined period of time, sequentially deleted.

In Step S1210, a prepared threshold value Th1 and the simultaneously driven number C(SUM) calculated in Step S1200 are compared with each other. Here, if C≤Th1, it is determined that an influence of noise is small, and the flow proceeds to Step S1220, where the number of sampled output values from the temperature sensors 801 is set to M that is a relatively small number of times. Then, in Step S1230, M temperature sensor output values temporarily stored in the memory 312 are read. In the present embodiment, it is assumed that the temperature sensor output values are obtained at the regular intervals of 10 msec, and stored in the main body memory only for the predetermined period of time. Therefore, in Step S1230, from among the plurality of output values stored in such a manner, the M output values in an interval traced back from the current time by an amount equal to M×10 msec are obtained. Subsequently, in Step S1240, the moving average process of the M output values obtained in Step S1230 is performed to calculate a corrected temperature SMA.

$$SMA(Tdi_{head}) = \frac{\sum_{k}^{M} Tdi_{head(k)}}{M} \tag{1}$$

On the other hand, in Step S1210, if it is determined that C>Th1, it is determined that the influence of noise is large, and the flow proceeds to Step S1250, where the number of samples from the temperature sensors 801 is set to N that is larger than M. Then, in Step S1260, N temperature sensor output values temporarily stored in the memory 312 are read. That is, from among the plurality of output values stored in the memory 312, the N output values in an interval traced back from the current time by an amount equal to N×10 msec are obtained. Subsequently, in Step S1270, the moving average process of the N output values obtained in Step S1260 is performed to calculate a corrected temperature SMA.

$$SMA(Tdi_{head}) = \frac{\sum_{k}^{N} Tdi_{head(k)}}{N} \tag{2}$$

This completes the current process to return to the next process that will be performed 10 msec later.

Figure 13:
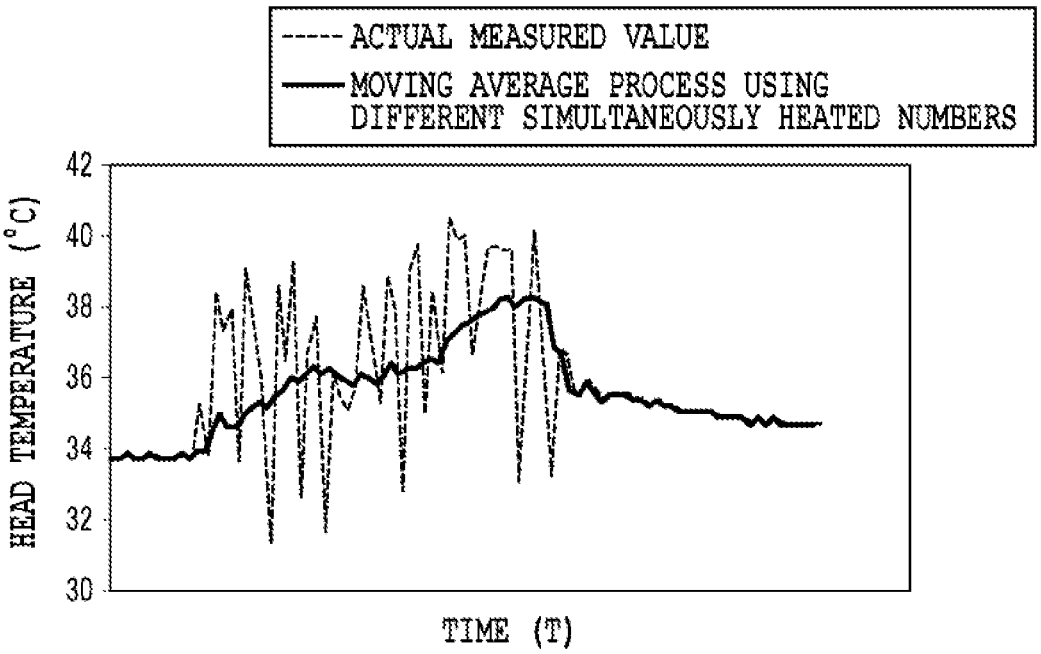
FIG. 13 is a diagram comparing a measured head temperature and a corrected temperature SMA in a first embodiment.

FIG. 13 is a diagram comparing a measured head temperature and the corrected temperature SMA in the case where the corrected temperature SMA is obtained according to the flowchart illustrated in FIG. 14. Illustrated here is a state under the condition that printing is performed at the same duties as those in FIG. 12; the threshold value is set as Th1=32; and the numbers of samples are set as M=1 and N=16. As compared with the moving average in FIG. 12 where the corrected temperature is calculated constantly on the basis of the results of every 16 samples, it turns out that the separation from the measured temperature in the low duty region is suppressed.

As described above, according to the present embodiment, the number of samples at the time of performing the moving average process of the temperature sensor output values is determined depending on the simultaneously driven number at each time. This enables, while suppressing an influence of noise, a temperature measurement of each of the printing element substrates to be made in a highly reliable state where there is no separation from an actual temperature.

Note that, in the above, for simplicity, the average process is performed by using the simple moving average process; however, the smoothing process for obtaining the corrected temperature SMA is not limited to this. For example, in order to further improve a real time property of a detected temperature, a weighted moving average process as expressed by the following expression can also be employed.

$$WMA(\text{Tdi_head}) = \frac{\dfrac{n \cdot Tdi_{headk} + (n-1)Tdi_{head(k-1)} + \ldots +}{2Tdi_{head(k-n+2)} + \text{Tdi_head}(k-n+1)}}{n + (n-1) + \ldots + 2 + 1} \tag{3}$$

In this case, by increasing a value of a coefficient n for a temperature output value at a time closer to the current time, and for an older temperature output value, decreasing the coefficient n, even in the case of comparatively increasing the number of samples, the separation from an actual measured temperature due to a drastic temperature change can be kept to a minimum.

Also, in the above, in order to make a comparison with the simultaneously driven number C, only one threshold value (Th1) is provided; however, it is also effective to provide a plurality of threshold values to set the number of sampled temperature sensor output values in a multistep manner.

Second Embodiment

It is assumed that the present embodiment also uses the inkjet printing apparatus and print head illustrated in FIGS. 1 to 6. In the present embodiment, described are, in addition to the first embodiment, a method that, for each print mode, varies the number of samples at the time of performing the moving average process of detecting sensor output values, and a method that, in order to stabilize ejection in a preliminary ejection operation unrelated to printing, control head temperature obtaining timing.

Figure 15:
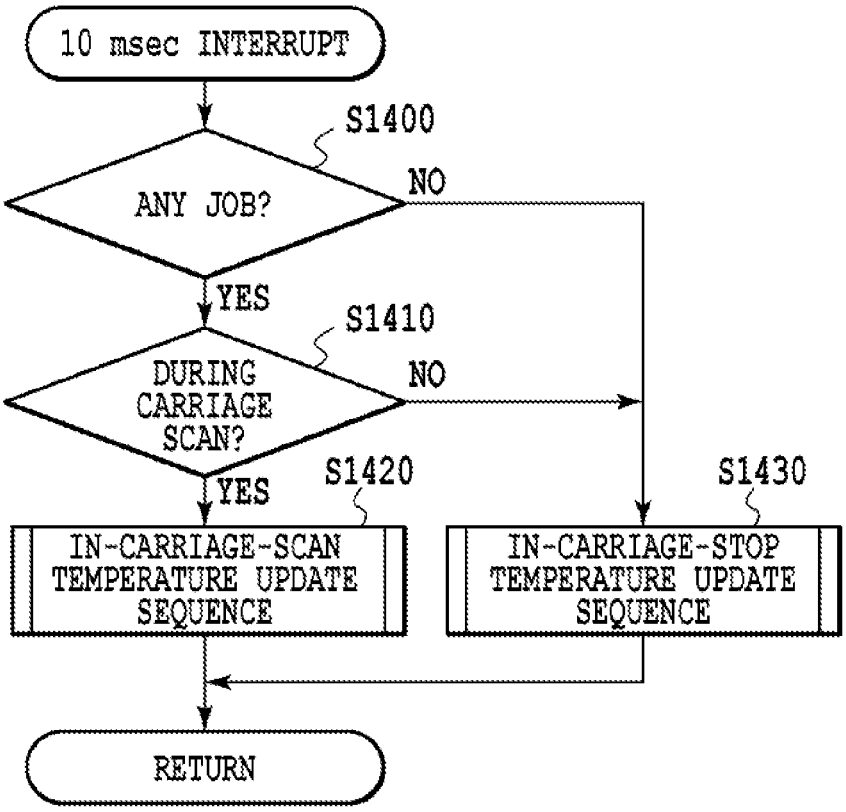
FIG. 15 is a flowchart explaining a temperature detecting sequence in a second embodiment.

FIG. 15 is a flowchart for explaining a temperature detecting sequence for each of the printing element substrates 801, which is performed by the ASIC 308 of the present embodiment. This sequence is assumed to be subjected to an interrupt process constantly at intervals of 10 msec when the inkjet printing apparatus is powered ON.

When this sequence is started, the ASIC 308 first determines in Step S1400 whether or not the inkjet printing apparatus has received a job. If the inkjet printing apparatus has received the job, the flow proceeds to Step S1410, where the ASIC 308 determines whether or not the carriage M4001 is currently scanning, and if the carriage M4001 is scanning, the flow proceeds to Step S1420, where an in-carriage-scan temperature update sequence is performed. On the other hand, if it is determined in Step S1400 that the inkjet printing apparatus has not received a job, or if it is determined in Step S1410 that the carriage is not scanning, the flow proceeds to Step S1430, where an in-carriage-stop temperature update sequence is performed.

Figure 16A:
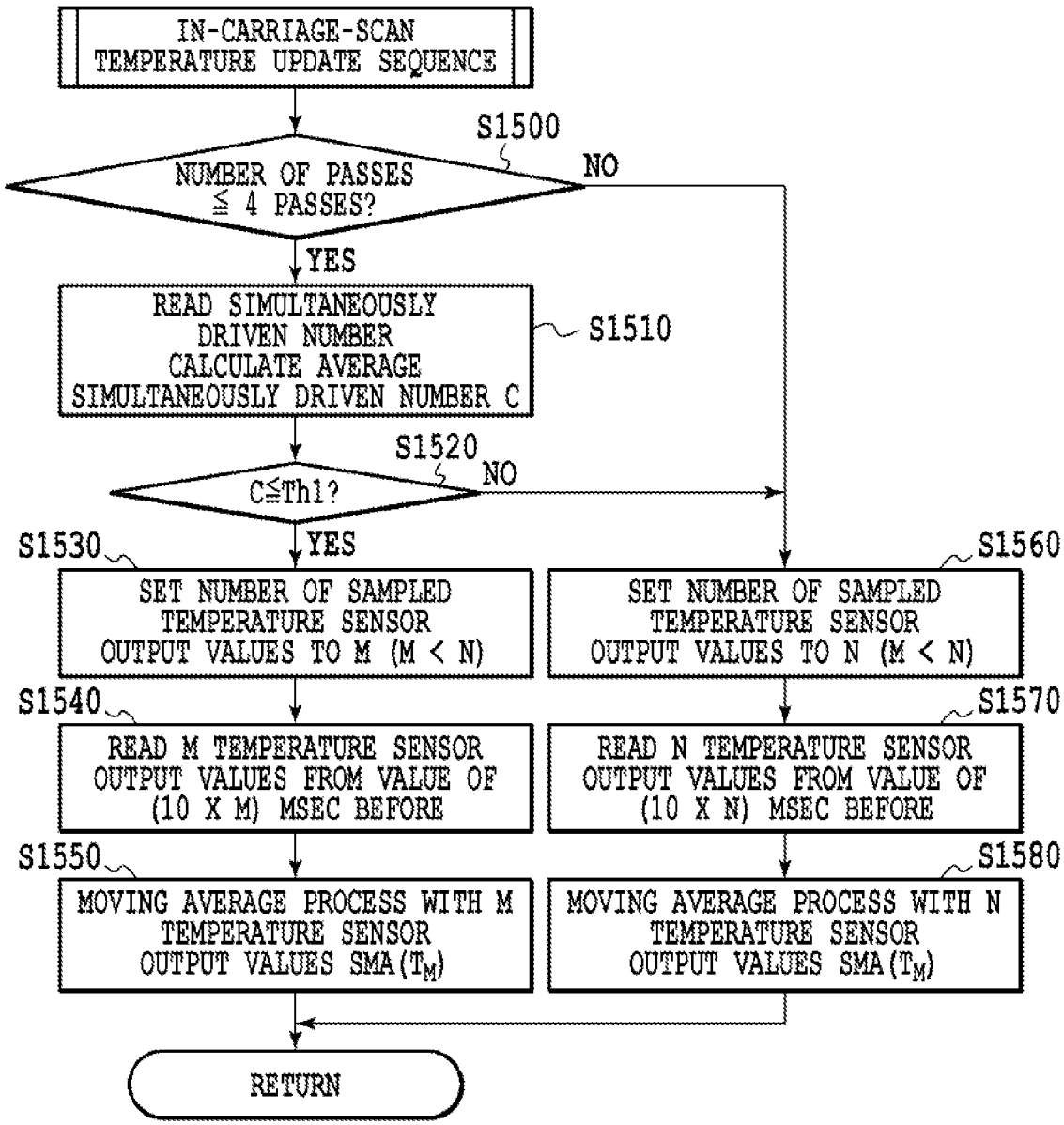
FIGS. 16A and 16B are flowcharts respectively explaining an in-carriage-scan temperature update sequence and an in-carriage-stop temperature update sequence.
Figure 16B:
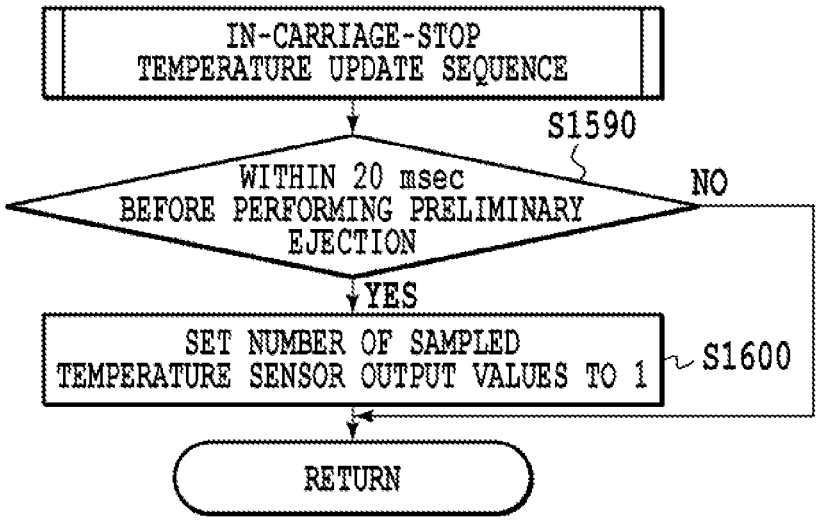

FIGS. 16A and 16B are flowcharts for respectively explaining the in-carriage-scan temperature update sequence and the in-carriage-stop temperature update sequence.

Referring to FIG. 16A, in the in-carriage-scan temperature update sequence, first, in Step S1500, it is determined whether or not a currently executing job is multipass printing having four passes or less. The multipass printing refers to a method that prints dots, which can be printed by one print scan of a print head, with the one print scan being divided into a plurality of print scans, and as the number of multi passes is increased, the number of times of driving per one print scan decreases to suppress an amount of change in head temperature. Therefore, in the present embodiment, in the case where the number of multi passes is five or more, it is determined that separation of a corrected temperature from an actual measured temperature along with a drastic change in head temperature does not occur, and in order to perform the average process with use of a relatively large number of samples (N), the flow directly proceeds to Step S1560. On the other hand, if it is determined in Step S1500 that the currently executing job is multipass printing having four passes or less, in order to perform the same process as that in the first embodiment, the flow proceeds to Step S1510.

Steps S1510 to S1580 are equivalent to Steps S1200 to S1270 in FIG. 14. Then, in Step S1550 or S1580, when the corrected temperature SMA is calculated, the ASIC returns to the next process that will be performed 10 in msec.

Referring to FIG. 16B, in the in-carriage-stop temperature update sequence, first, in Step S1590, it is determined whether or not the current time is within 20 msec before the preliminary ejection operation. The preliminary ejection operation refers to an ejection operation that is, in order to stabilize ejection, preliminarily performed prior to a print operation, and typically performed at a higher duty (128 times ~) than that of an ejection operation at the time of printing. An appropriate pulse setting is required also for the preliminary ejection, and therefore in Step S1590, if it is determined that the current time is at most 20 msec before the preliminary ejection operation, the flow proceeds to Step S1600 in order to obtain a head temperature. On the other hand, in Step S1590, if it is determined that the current time is not at most 20 msec before the preliminary ejection operation, it is determined that at the current time, it is not necessary to obtain the head temperature, and this process is ended.

Figure 17:
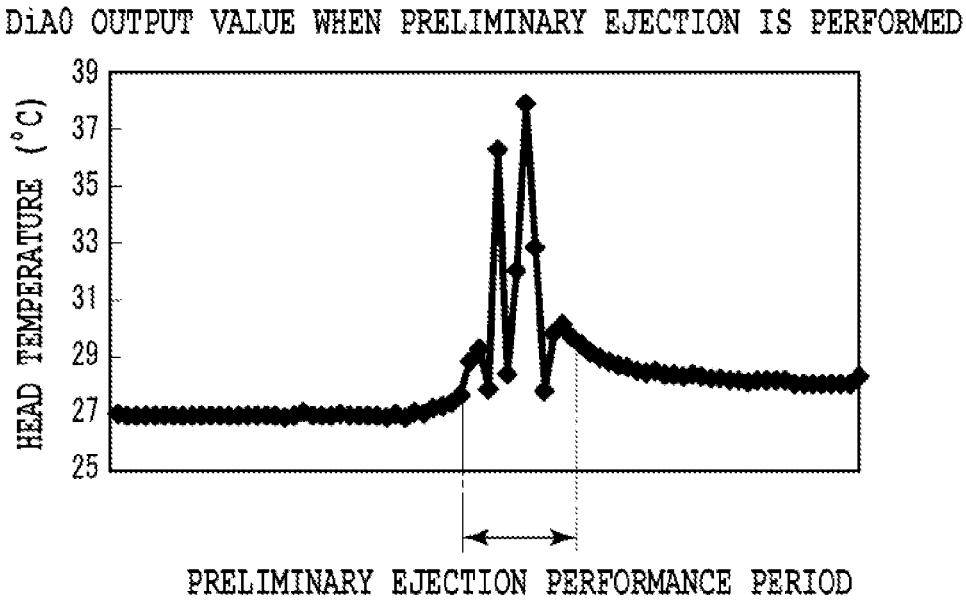
FIG. 17 is a diagram plotting a head temperature corresponding to output values of the temperature sensors obtained when the preliminary ejection was performed.

FIG. 17 is a diagram plotting temperature sensor output values obtained when the preliminary ejection was performed. During a period of the preliminary ejection, the high duty ejection operation is performed, and therefore large noise occurs. Even if the average process is performed with use of a result of sampling during the preliminary ejection during which the large noise is superimposed on a temperature sensor output signal, an accurate head temperature cannot be obtained.

Therefore, in the present embodiment, during such a preliminary ejection period, a head temperature detecting operation itself is avoided. For this reason, in Step S1600, a head temperature obtained by one sampling immediately before the preliminary ejection operation is set as the corrected temperature SMA. As a result, with use of a pulse set on the basis of the one sampling, the preliminary ejection is performed.

As described above, according to the present embodiment, in addition to the above-described effect of the first embodiment, the number of sampled head temperatures can be efficiently set depending on a print mode. Also, even during the preliminary ejection operation that is likely to give rise to noise, an influence of the noise can be avoided to obtain a head temperature.

Third Embodiment

It is assumed that the present embodiment also uses the inkjet printing apparatus and print head illustrated in FIGS. 1 to 6.

Referring to FIG. 6 again, in each of the printing element substrates 801, of the two temperature sensors 701 and 702, the wiring line 1102 from the temperature sensor 702 to the contact terminal wiring board 804 is longer than the wiring line 1104 from the temperature sensor 701 to the contact terminal wiring board 804. That is, correspondingly to the longer wiring distance, noise is likely to be superimposed on an analog signal from the temperature sensor 702 rather than an analog signal from the temperature sensor 701. Therefore, in the present embodiment, the number of samples is determined on the basis of output values of any of the two temperature sensors 701 and 702 on the printing element substrate 801.

Figure 18:
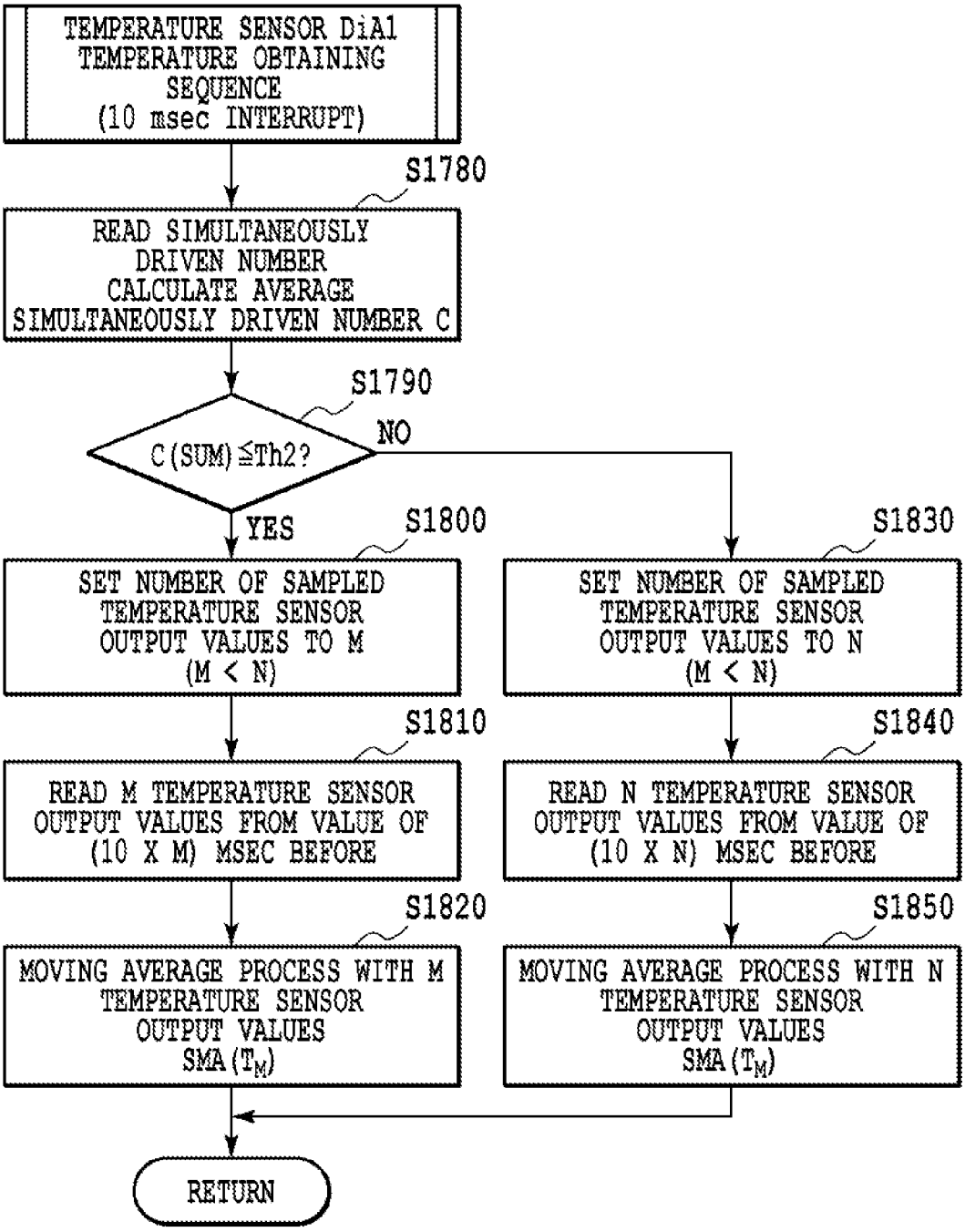
FIG. 18 is a flowchart explaining a temperature detecting sequence in a third embodiment.

FIG. 18 is a flowchart illustrating a sequence for the ASIC 308 of the present embodiment to obtain temperature from the temperature sensor 702. Also, regarding the temperature sensor 701, according to the sequence already illustrated in FIG. 14, temperature is obtained. FIG. 18 is different from FIG. 14 in that a threshold value Th2 that is compared with an average simultaneously driven number C of the printing element substrate is set to a smaller value than the threshold value Th1 in FIG. 14 (Th2<Th1). By doing this, for the temperature sensor 702 having the longer wiring distance, the number of samples having a large value (N) is easily set, and a reduction in noise is regarded as more important. The ASIC 308 of the present embodiment can averages the two corrected temperatures SMA respectively based on the different numbers of samples to determine the average as a detected temperature of the printing element substrate 801.

In addition, the present embodiment is configured to make a threshold value to be compared with an average simultaneously driven number C different between the temperature sensors 701 and 702; however, it is also effective to, for example, while setting the threshold values to the same value, make different the numbers of samples to be set. Specifically, it is only necessary that the number of samples for the temperature sensor 701 having a shorter wiring distance is set to M or N, whereas the number of samples for the temperature sensor 702 having the longer wiring distance is set to M' (>M) or N' (>N).

Fourth Embodiment

It is assumed that the inkjet printing apparatus and print head illustrated in FIGS. 1 to 5 are used. In any of the above embodiments, described is the case where temperature detection is performed on one of the printing element substrates; however, in the present embodiment, described is the case where temperature detection is performed on a plurality of parallel arrayed printing element substrates.

Figure 19:
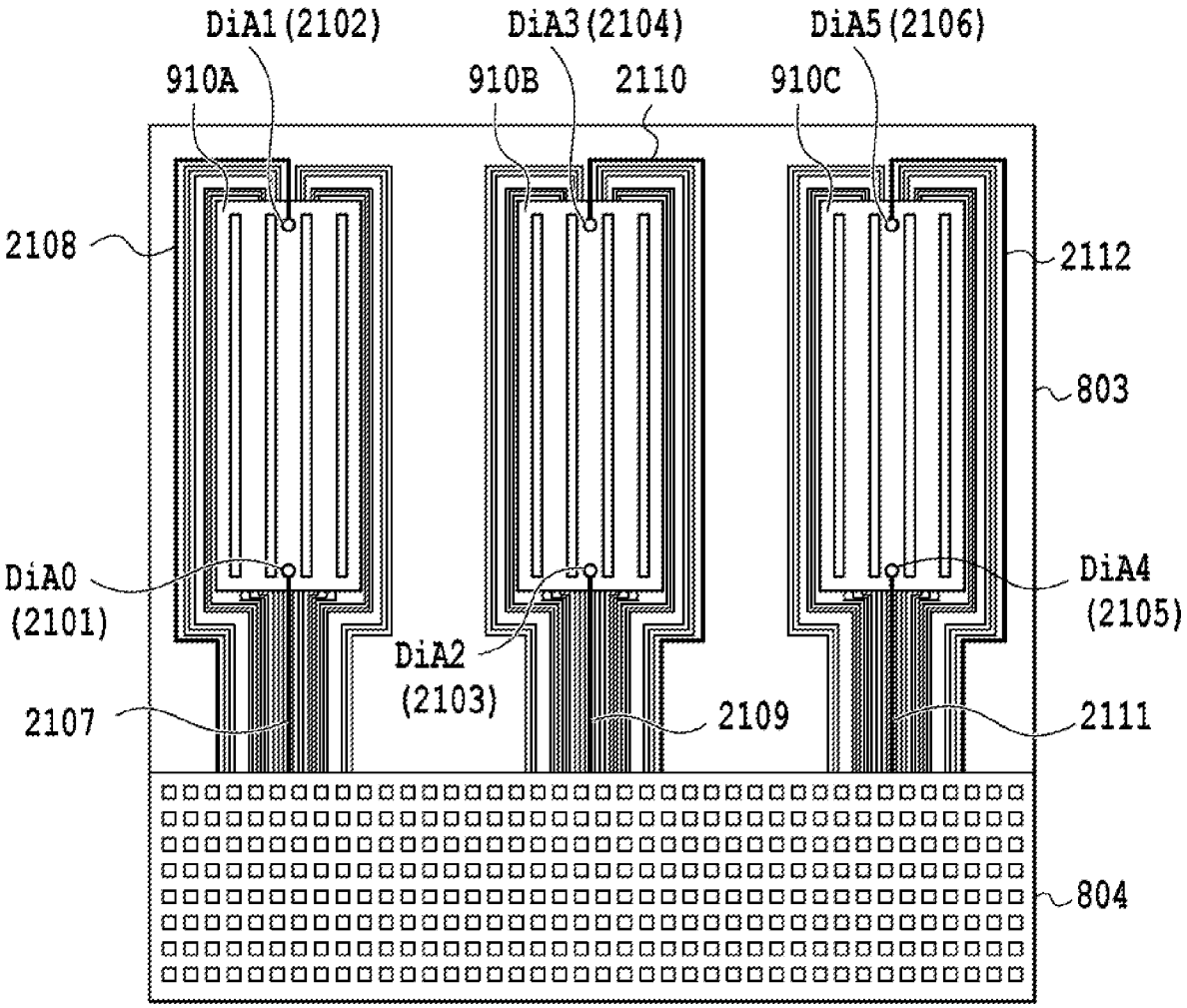
FIG. 19 is a diagram illustrating an array state of printing element substrates in a fourth embodiment.

FIG. 19 is a diagram illustrating an array state of printing element substrates in the present embodiment. Here, the printing element substrates illustrated in FIG. 6 are parallel arranged in the X direction. In the case of such a configuration, regarding wiring lines 2108 and 2112 of the printing element substrates 910A and 910C on the both sides, by configuring the wiring lines 2108 and 2112 to detour in side parts on sides opposite to the mutual printing element substrates as illustrated in the diagram, the temperature detection can be performed with the same accuracy as those in the above-described embodiments. However, in the central printing element substrate 910B, even if a wiring line for a temperature sensor 2104 on a side further away from the contact wiring board 804 is detoured on any of the right and left sides, a path of the wiring line is influenced by current interference from drive wiring lines of an adjacent printing element substrate. That is, an amount of noise superimposed on the wiring line 2110 is larger than that superimposed on the wiring line 2108 or 2112.

In light of the above situation, in the present embodiment, regarding the temperature sensor 2104 of the central printing element substrate 910B, a corrected temperature SMA is calculated in consideration of an influence of noise received from a printing element substrate closer to the wiring line 2110 for the temperature sensor 2104. Specifically, by not only counting a simultaneously driven number of the printing element substrate 910B, but also counting a simultaneously driven number of the printing element substrate 910C, the number of samples for the temperature sensor 2104 is set.

Figure 20:
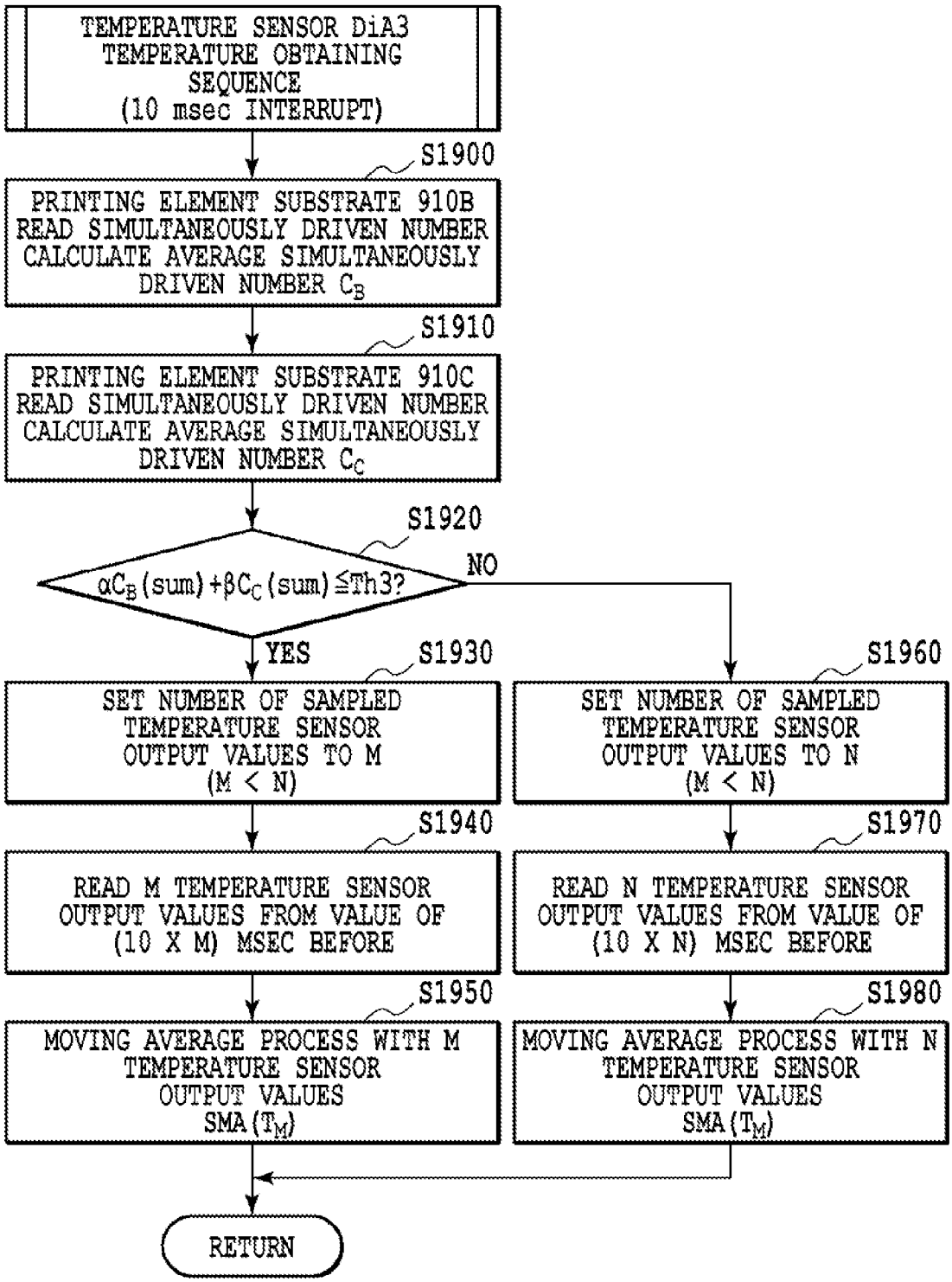
FIG. 20 is a flowchart explaining a temperature detecting sequence in the fourth embodiment.

FIG. 20 is a flowchart for explaining a temperature detecting sequence for the temperature sensor 2104, which is performed by the ASIC 308 of the present embodiment. When this sequence is started, in Step S1900, the ASIC 308 first searches the memory 312 of the main body main board 306 to count the number of driven printing elements on the printing element substrate 910B within a predetermined period of time. Then, from the driven number, a simultaneously driven number CB at one drive timing in the printing element substrate is calculated. Further, in Step S1910, the ASIC 308 searches the memory 312 of the main body main board 306 to count a driven number on the printing element substrate 910C for the certain period of time. Then, from the driven number, a simultaneously driven number CC at one drive timing in the printing element substrate is calculated.

In Step S1920, values obtained by multiplying the average simultaneously driven numbers CB and CC obtained in Steps S1900 and S1910 by weighting factors $\alpha$ and $\beta$ ($<\alpha$) respectively are summed up, and a resultant value is compared with a threshold value Th3. Then, if $\alpha CB+\beta CC \leq Th3$, it is determined that the amount of noise influencing the wiring line 2110 is small, and the flow proceeds to Step S1930, where the number of samples for the temperature sensor 2104 is set to M. On the other hand, if $\alpha CB+\beta CC > Th3$, it is determined that the amount of noise influencing the wiring line 2110 is large, and the flow proceeds to Step S1960, where the number of samples for the temperature sensor 2104 is set to N (N>M).

In the present embodiment, the temperature sensors 2101, 2103, and 2105 can detects temperatures according to the sequence illustrated in FIG. 14. Also, the temperature sensors 2102 and 2106 can detect temperatures according to the sequence that is described in the third embodiment and illustrated in FIG. 18. Further, for each of the substrates 910A, 910B, and 910C, the ASIC 308 averages two corrected temperatures respectively based on the different numbers of samples, and can thereby determine the average as a conclusive detected temperature of each of the printing element substrates.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-084827, filed Apr. 3, 2012, which is hereby incorporated by reference herein in its entirety.

What is claimed is:

1. An inkjet printing apparatus comprising:

a print head having a printing element substrate provided with a printing element array in which a plurality of printing elements for ejecting ink are arranged in an arranging direction, and a temperature sensor;

a first obtaining unit configured to obtain information regarding a number of simultaneously driven printing elements among the plurality of printing elements within a predetermined time interval;

a second obtaining unit configured to obtain information regarding a temperature of the printing element substrate based on a plurality of output values outputted from the temperature sensor at a plurality of timings;

a determining unit configured to determine a driving pulse to be applied to the printing elements based on the temperature indicated by the information obtained by the second obtaining unit; and a controlling unit configured to control ejecting ink from the print head by applying the driving pulse determined by the determining unit to the printing elements, wherein i) in a case that the number of simultaneously driven printing elements among the plurality of printing elements indicated by the information obtained by the first obtaining unit is a first number, the second obtaining unit obtains the information regarding the temperature of the printing element substrate based on M output values outputted from the temperature sensor, and (ii) in a case that the number of simultaneously driven printing elements among the plurality of printing elements indicated by the information obtained by the first obtaining unit is a second number which is greater than the first number, the second obtaining unit obtains the information regarding the temperature of the printing element substrate based on N (N is greater than M) output values outputted from the temperature sensor.

2. The inkjet printing apparatus according to claim 1, wherein the print head further comprises an electric line member which is electrically contacted with the printing element substrate, the electric line member being provided with a driving line for applying energy to drive the plurality of printing elements, and an output line for transmitting signals from the temperature sensor to the printing apparatus, wherein a part of the driving line and a part of the output line are provided in parallel.

3. The inkjet printing apparatus according to claim 1, wherein the second obtaining unit obtains the information regarding a temperature of the printing element substrate based on a plurality of output values outputted from the temperature sensor at a regular time cycle.

4. The inkjet printing apparatus according to claim 1, further comprising a scanning unit configured to scan the print head across a unit area of a print medium one or more times; and a third obtaining unit configured to obtain information regarding a number of scannings of the print head across the unit area by the scanning unit, wherein (i) in a case that the number of scannings of the print head indicated by the information obtained by the third obtaining unit is a third number and the number of simultaneously driven printing elements among the plurality of printing elements indicated by the information obtained by the first obtaining unit is the first number, the second obtaining unit performs an average process of M output values outputted from the temperature sensor, (ii) in a case that the number of scannings of the print head indicated by the information obtained by the third obtaining unit is the third number and the number of simultaneously driven printing elements among the plurality of printing elements indicated by the information obtained by the first obtaining unit is the second number, the second obtaining unit performs an average process of N output values outputted from the temperature sensor, and (iii) in a case that the number of scannings of the print head indicated by the information obtained by the third obtaining unit is a fourth number which is greater than the third number, the second obtaining unit performs an average process of N output values outputted from the temperature sensor.

5. The inkjet printing apparatus according to claim 1, wherein the second obtaining unit does not perform a detection operation based on the temperature sensor while the inkjet printing apparatus is performing preliminary ejection.

6. The inkjet printing apparatus according to claim 1, wherein the output values from the temperature sensor are transmitted as analog signals, and the second obtaining unit performs an amplification process and an A/D conversion on the analog signals to obtain the temperature of the printing element substrate.

7. The inkjet printing apparatus according to claim 1, wherein (i) in a case that the number of simultaneously driven printing elements among the plurality of printing elements indicated by the information obtained by the first obtaining unit is the first number, the second obtaining unit performs an average process of M output values outputted from the temperature sensor to obtain the information regarding the temperature of the printing element substrate, and (ii) in a case that the number of simultaneously driven printing elements among the plurality of printing elements indicated by the information obtained by the first obtaining unit is the second number, the second obtaining unit performs an average process of N output values outputted from the temperature sensor to obtain the information regarding the temperature of the printing element substrate.

8. The inkjet printing apparatus according to claim 7, wherein:

the printing element substrate is provided with a plurality of temperature sensors, and for each of the temperature sensors, the second obtaining unit determines a number of output values used for the average process.

9. The inkjet printing apparatus according to claim 8, wherein the plurality of temperature sensors include a first temperature sensor which is connected to the printing apparatus through a first output line for transmitting signals, and a second temperature sensor which is connected to the printing apparatus through a second output line which is longer than the first output line for transmitting signals, and wherein the second obtaining unit performs an average process for the first and second temperature sensors such that a number of output values outputted from the second temperature sensor used for the average process is greater than a number of output values outputted from the second temperature sensor used for the average process.

10. The inkjet printing apparatus according to claim 7, wherein the average process is a moving average process.

11. The inkjet printing apparatus according to claim 1, wherein the printing element array comprises a plurality of printing element groups, each including a plurality of printing elements and being driven divisionally at different timings, and the information regarding a number of simultaneously driven printing elements among the plurality of printing elements is a number of times of driving the plurality of printing elements of a same printing element group among the plurality of the printing element groups at the same time.

12. The inkjet printing apparatus according to claim 1, wherein the printing element array comprises a plurality of printing element groups, each including a plurality of printing elements and being driven divisionally at different timings, and the predetermined time interval corresponds to one timing of the different timings.

13. The inkjet printing apparatus according to claim 1, wherein the determining unit determines the driving pulse at least at a first timing in the plurality of timings, the M output values are outputted at timings between the first timing and a second timing which is M times a multiplier before the first timing in the plurality of timings, and the N output values are outputted at timings between the first timing and a third timing which is N times the multiplier before the first timing in the plurality of timings.

14. An inkjet printing method of an ink jet printing apparatus which comprises a print head having a printing element substrate provided with a printing element array in which a plurality of printing elements for ejecting ink are arranged in an arranging direction, and a temperature sensor, the inkjet printing method comprising:

a first obtaining step of obtaining information regarding a number of simultaneously driven printing elements among the plurality of printing elements within a predetermined time interval;

a second obtaining step of obtaining information regarding a temperature of the printing element substrate based on a plurality of output values outputted from the temperature sensor at a plurality of timings a determining step of, determining a driving pulse to be applied to the printing elements based on the temperature of the printing element substrate indicated by the information, the temperature being obtained in the second obtaining step; and a controlling step of controlling ejection of ink from the print head by applying the driving pulse determined in the determining step to the printing elements, wherein (i) in a case that the number of simultaneously driven printing elements among the plurality of printing elements indicated by the information obtained in the first obtaining step is a first number, the second obtaining step obtains the information regarding the temperature of the printing element substrate based on M output values outputted from the temperature sensor, and (ii) in a case that the number of simultaneously driven printing elements among the plurality of printing elements indicated by the information obtained in the first obtaining step is a second number which is greater than the first number, the second obtaining step obtains the information regarding the temperature of the printing element substrate based on N (N is greater than M) output values outputted from the temperature sensor.

* * * * *